US010990040B2

(12) United States Patent
Hagiwara et al.

(10) Patent No.: US 10,990,040 B2
(45) Date of Patent: Apr. 27, 2021

(54) TRANSFER DEVICE AND IMAGE FORMING APPARATUS

(71) Applicant: FUJI XEROX CO., LTD., Tokyo (JP)

(72) Inventors: Kazuyoshi Hagiwara, Kanagawa (JP); Kentaro Iwamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/546,922

(22) Filed: Aug. 21, 2019

(65) Prior Publication Data

US 2020/0301317 A1 Sep. 24, 2020

(30) Foreign Application Priority Data

Mar. 22, 2019 (JP) ..... JP2019-055100

(51) Int. Cl.
*G03G 15/16* (2006.01)

(52) U.S. Cl.
CPC ..... *G03G 15/161* (2013.01)

(58) Field of Classification Search
CPC ..... G03G 15/161; G03G 15/1615
See application file for complete search history.

(56) References Cited

U.S. PATENT DOCUMENTS 4,174,171 A * 11/1979 Hamaker ..... G03G 15/755 198/806
8,543,036 B2 * 9/2013 Nakamura ..... G03G 15/1605 399/121
2004/0013452 A1 * 1/2004 Choi ..... G03G 15/1605 399/313
2005/0123326 A1 * 6/2005 Ito ..... G03G 15/01 399/313
2009/0207461 A1 * 8/2009 Hodoshima ..... G03G 15/5029 358/498
2011/0255910 A1 * 10/2011 Sekine ..... G03G 15/0131 399/313
2014/0023387 A1 * 1/2014 Goto ..... G03G 15/1615 399/66
2015/0117914 A1 * 4/2015 Hozumi ..... G03G 15/657 399/312
2015/0125189 A1 * 5/2015 Hozumi ..... G03G 15/1615 399/308

FOREIGN PATENT DOCUMENTS

JP 2006-267704 A 10/2006
JP 2006-276294 A 10/2006
JP 2007-11107 A 1/2007

* cited by examiner

*Primary Examiner* — G. M. A Hyder
(74) *Attorney, Agent, or Firm* — Sughrue Mion, PLLC

(57) ABSTRACT

A transfer device includes a transfer unit and an adjustment unit. The transfer unit includes a transfer belt and a transfer roller. The transfer belt is wound around a rotating winding roller to circulate. An image is to be formed on the transfer belt. The transfer roller is disposed on an opposite side of the winding roller across the transfer belt. The transfer roller is configured to transfer the image on the transfer belt to a recording medium. The adjustment unit is configured to change an axial direction of the transfer roller to adjust parallelism between an axis of the transfer roller and an axis of the winding roller.

17 Claims, 23 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2019-055100 filed Mar. 22, 2019.

BACKGROUND

(i) Technical Field

The present disclosure relates to a transfer device and an image forming apparatus.

(ii) Related Art

An image forming apparatus described in JP-A-2006-267704 adjusts a position of a cam of a BTB mechanism and an inclination angle of an idle roller with respect to a driving roller to generate a difference between a circumferential length on the inside of a secondary transfer transport belt and a circumferential length on the outside thereof, thereby bending the transport direction of a sheet.

SUMMARY

A recording medium passes through a nip portion formed between a winding roller around which a transfer belt on which an image is formed is wound and a transfer roller provided in a transfer unit, so that the image formed on the transfer belt is transferred to the recording medium.

In the related art, in order to achieve good image parallelism of an image formed on a recording medium, the axial direction of the winding roller is changed, and parallelism between the axis of the transfer roller and the axis of the winding roller (that is, roll parallel alignment) is adjusted. However, changing the axial direction of the winding roller may cause the transfer belt wound around the winding roller to move in the width direction of the transfer belt.

Aspects of non-limiting embodiments of the present disclosure relate to providing a configuration to adjust the parallelism between the axis of a transfer roller and the axis of a winding roller and preventing a transfer belt from moving in a width direction of the transfer belt as compared with a case where the axial direction of the winding roller is changed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transfer device including: a transfer unit including a transfer belt wound around a rotating winding roller to circulate, an image being to be formed on the transfer belt, and a transfer roller disposed on an opposite side of the winding roller across the transfer belt, the transfer roller configured to transfer the image on the transfer belt to a recording medium; an adjustment unit configured to change an axial direction of the transfer roller to adjust parallelism between an axis of the transfer roller and an axis of the winding roller.

BRIEF DESCRIPTION OF THE DRAWINGS

Exemplary embodiment(s) of the present disclosure will be described in detail based on the following figures, wherein.

DETAILED DESCRIPTION

First Exemplary Embodiment

An example of a transfer device and an image forming apparatus according to a first exemplary embodiment of the present disclosure will be described with reference to FIGS. 1 to 19. Furthermore, the arrow H illustrated in each drawing indicates the apparatus height direction as the vertical direction, the arrow W indicates the apparatus width direction as the horizontal direction, and the arrow D indicates the apparatus depth direction as the horizontal direction.

(Overall Configuration of Image Forming Apparatus)

Figure 17:
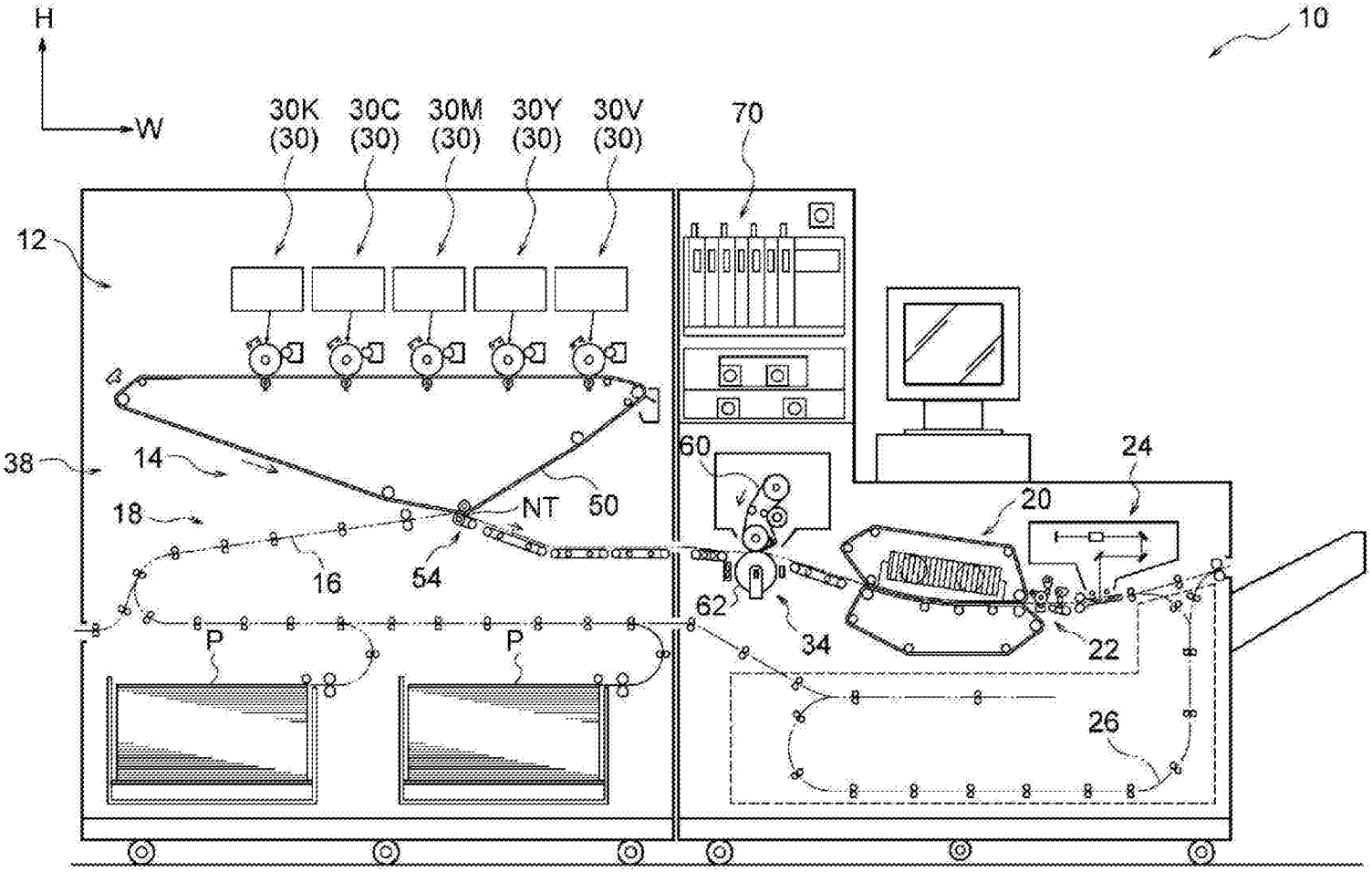
FIG. 17 is a schematic view illustrating a configuration of the image forming apparatus according to the first exemplary embodiment of the present disclosure.

As illustrated in FIG. 17, an image forming apparatus 10 includes an image forming device 12 that forms an image by an electrophotography method, and plural transport members that transport a sheet member P, which is a recording medium on which an image is to be formed, along a transport path 16 of the sheet member P. Reference numerals of the plural transport members may be omitted.

The image forming apparatus 10 further includes a cooling unit 20 that cools the sheet member P on which the image has been formed, a correction unit 22 that corrects the curvature of the sheet member P, and an image inspection unit 24 that inspects the image formed on the sheet member P.

In addition, in order to form images on both sides of the sheet member P (that is, to perform duplex printing), the image forming apparatus 10 includes a reverse path 26 which reverses the front and back surfaces of the sheet member having a surface on which the image has been formed and again transports the sheet member P toward the image forming device 12. The image forming apparatus 10 further includes a controller 70 that controls respective units.

In the image forming apparatus 10 configured as described above, a toner image formed by the image forming device 12 is formed on the surface of the sheet member P transported along the transport path 16. In addition, the sheet member P on which the toner image has been formed passes through the cooling unit 20, the correction unit 22, and the image inspection unit 24 in this order and is discharged to the outside of the apparatus.

On the other hand, when forming an image on a back surface of the sheet member P, the sheet member P having the surface on which the image has been formed is transported along the reverse path 26, and an image is again formed on the back surface of the sheet member P in the image forming device 12.

[Image Forming Device 12]

As illustrated in FIG. 17, the image forming device 12 includes plural toner image forming units 30 that respectively form toner images of respective colors and a transfer device 38 that transfers the toner images formed in the toner image forming units 30 onto the sheet member P. In addition, the image forming device 12 includes a fixing unit 34 that fixes the toner images transferred onto the sheet member P by the transfer device 38 to the sheet member P.

—Toner Image Forming Unit 30—

The plural image forming units 30 are provided to form toner images of respective colors. In the present exemplary embodiment, the toner image forming units 30 of a total of five colors including a spot color (V), yellow (Y), magenta (M), cyan (C), and black K) are provided. Then, yellow (Y), magenta (M), cyan (C), and black (K) are basic colors used to reproduce a requested color. Further, "V," "Y," "M," "C," and "K" illustrated in FIG. 17 indicate the respective colors. Furthermore, in the following description, when it is not necessary to distinguish between the spot color (V), yellow (Y), magenta (M), cyan (C), and black (K), "V," "Y," "M," "C," and "K" added to the reference numerals are omitted.

Figure 16:
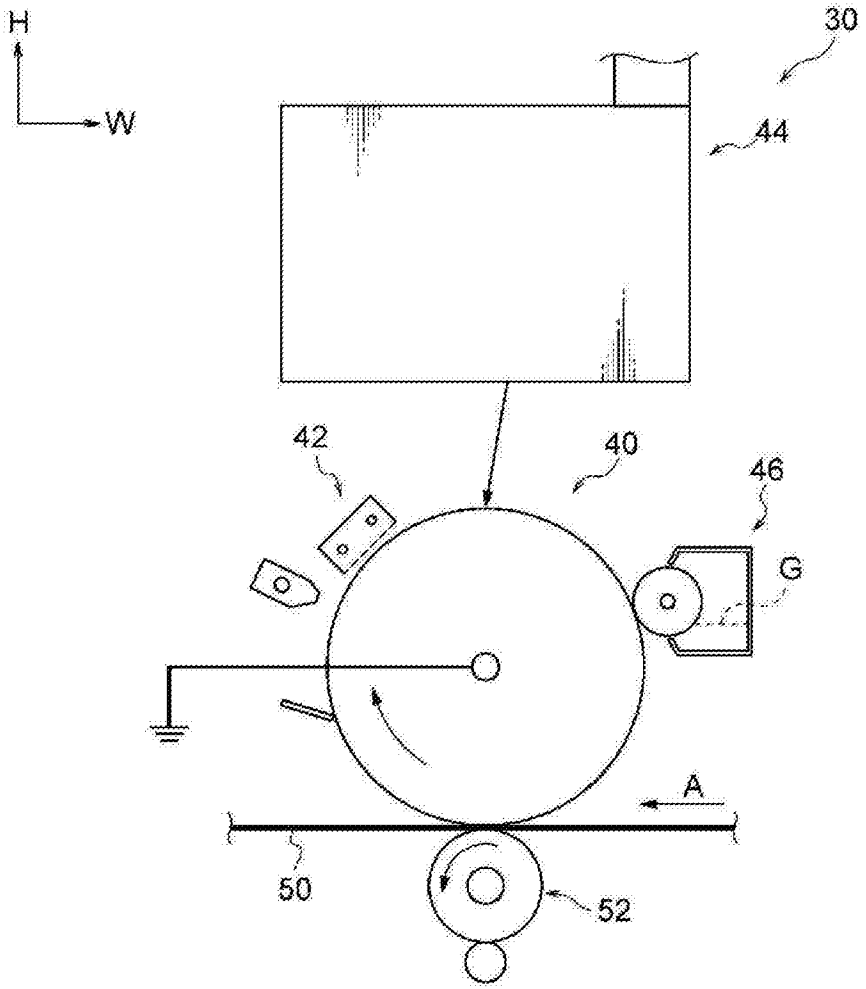
FIG. 16 is a view illustrating a configuration of a toner image forming unit of an image forming apparatus according to the first exemplary embodiment of the present disclosure.

The toner image forming unit 30 of each color is basically configured in the same manner except for a toner to be used, and as illustrated in FIG. 16, includes a rotating cylindrical image carrier 40 and a charger 42 which charges the image carrier 40. In addition, the toner image forming unit 30 includes an exposure device 44 which irradiates the charged image carrier 40 with exposure light to form an electrostatic latent image and a developing device 46 which develops the electrostatic latent image into a toner image using a developer G containing a toner.

Figure 15:
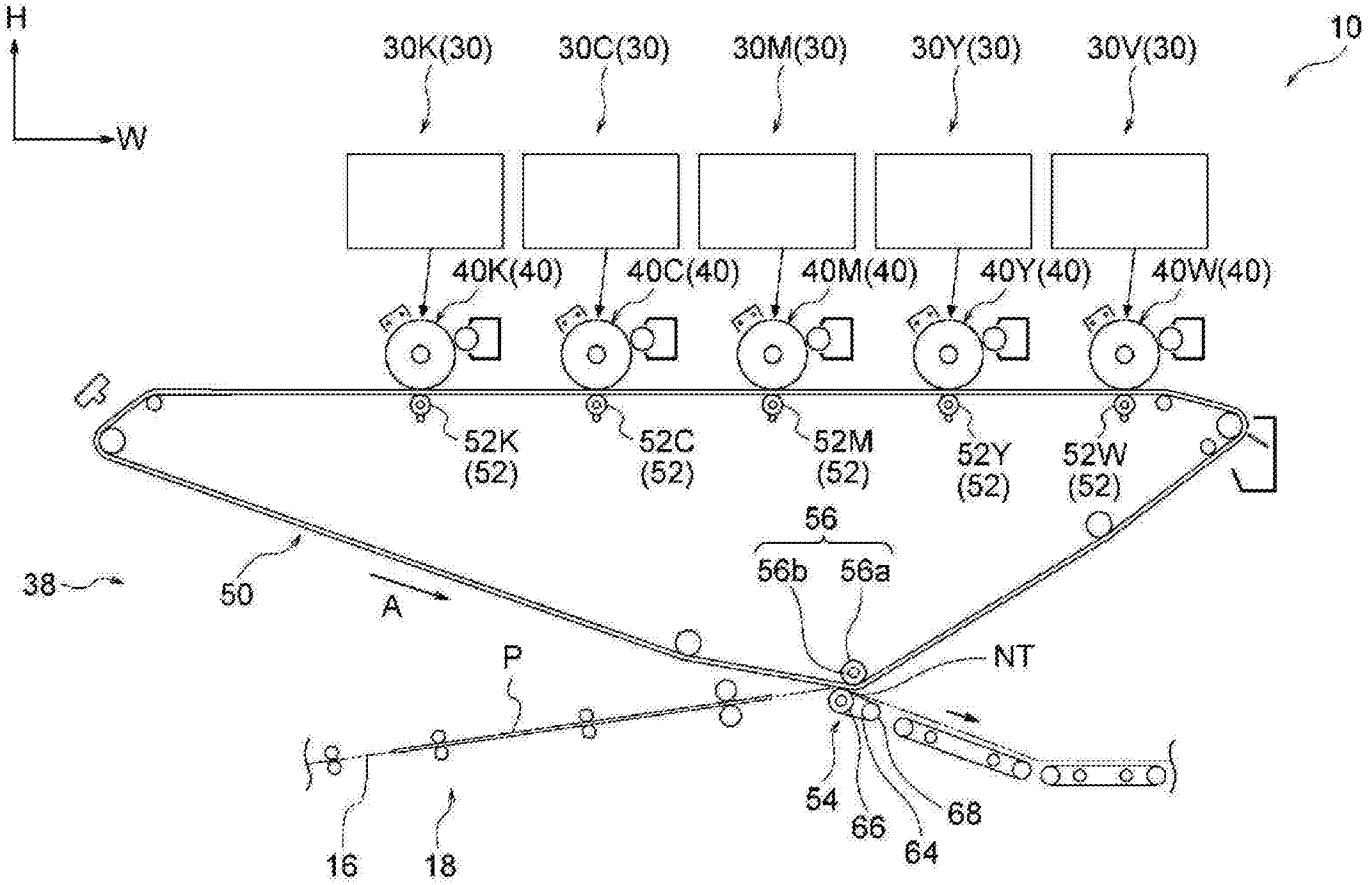
FIG. 15 is a view illustrating a configuration of the transfer device according to the first exemplary embodiment of the present disclosure.

Further, as illustrated in FIG. 15, the image carrier 40 of each color is in contact with a transfer belt 50 which moves in a circulating manner. Then, the toner image forming units 30 of the spot color (V), yellow (Y), magenta (M), cyan (C), and black (K) are arranged side by side in the horizontal direction in this order from the upstream side in the circulating direction of the transfer belt 50 (see the arrow A in the drawing). Further, the toner image forming unit of each color is adapted to form an image of each color using a toner of each color.

—Transfer Device 38—

As illustrated in FIG. 15, the transfer device 38 includes the transfer belt 50 which is wound around plural rollers (the reference numerals of which are omitted) to circulate in the direction of the arrow A in the drawing and a primary transfer roller 52 of each color which transfers the toner image formed on the image carrier 40 of each color onto the transfer belt 50.

The primary transfer roller 52 is disposed on the opposite side of the image carrier 40 with the transfer belt 50 interposed therebetween. Then, the primary transfer roller 52 is adapted such that a transfer bias voltage (positive voltage) having a polarity reverse to toner polarity (for example, negative polarity in the present exemplary embodiment) is applied thereto by a power supply unit (not illustrated). Transfer current flows between the primary transfer roller 52 and the image carrier 40 by the application of the transfer bias voltage, so that the toner image formed on the image carrier 40 is transferred onto the transfer belt 50.

In addition, the transfer device 38 includes a winding roller 56 around which the transfer belt 50 is wound. Further, the winding roller 56 includes a cylindrical main body portion 56*a* formed of an elastic member and a shaft portion 56*b*. The axial direction of the main body portion 56*a* is the apparatus depth direction. The shaft portion 56*b* penetrates the inside of the main body portion 56*a* (see FIG. 1). Furthermore, the transfer device 38 includes a secondary transfer unit 54 having a secondary transfer roller 66. The secondary transfer roller 66 is disposed on the opposite side of the winding roller 56 with the transfer belt 50 interposed therebetween. The secondary transfer roller 66 transports the sheet member P sandwiched between the secondary transfer roller 66 and the transfer belt 50. The secondary transfer unit 54 transfers the toner image on the transfer belt 50 onto the recording medium.

Thus, a transfer nip NT which transfers the toner image onto the sheet member P is formed between the secondary transfer roller 66 and the transfer belt 50. Then, the winding roller 56 is configured so that a transfer bias voltage (positive voltage) having a polarity reverse to toner polarity is applied thereto by a power supply unit (not illustrated). Transfer current flows between the secondary transfer roller 66 and the winding roller 56 due to the application of the transfer bias voltage, and the toner image is transferred (formed) from the transfer belt 50 onto the sheet member P passing through the transfer nip NT.

In this configuration, the toner images are primarily transferred in a superimposed manner onto the transfer belt 50 by the primary transfer rollers 52 in the order of the spot color (V), yellow (Y), magenta (M), cyan (C), and black (K). Further, the superimposed toner images are secondarily transferred onto the sheet member P passing through the transfer nip NT by the secondary transfer unit 54.

Furthermore, details of the secondary transfer unit 54 will be described later.

(Major Part Configuration)

Next, the secondary transfer unit 54 provided in the transfer device 38, an adjustment unit 102 that adjusts the position of the secondary transfer unit 54, a controller 106 that controls respective units, and the image inspection unit 24 provided in the image forming apparatus 10 will be described.

[Secondary Transfer Unit 54]

Figure 1:
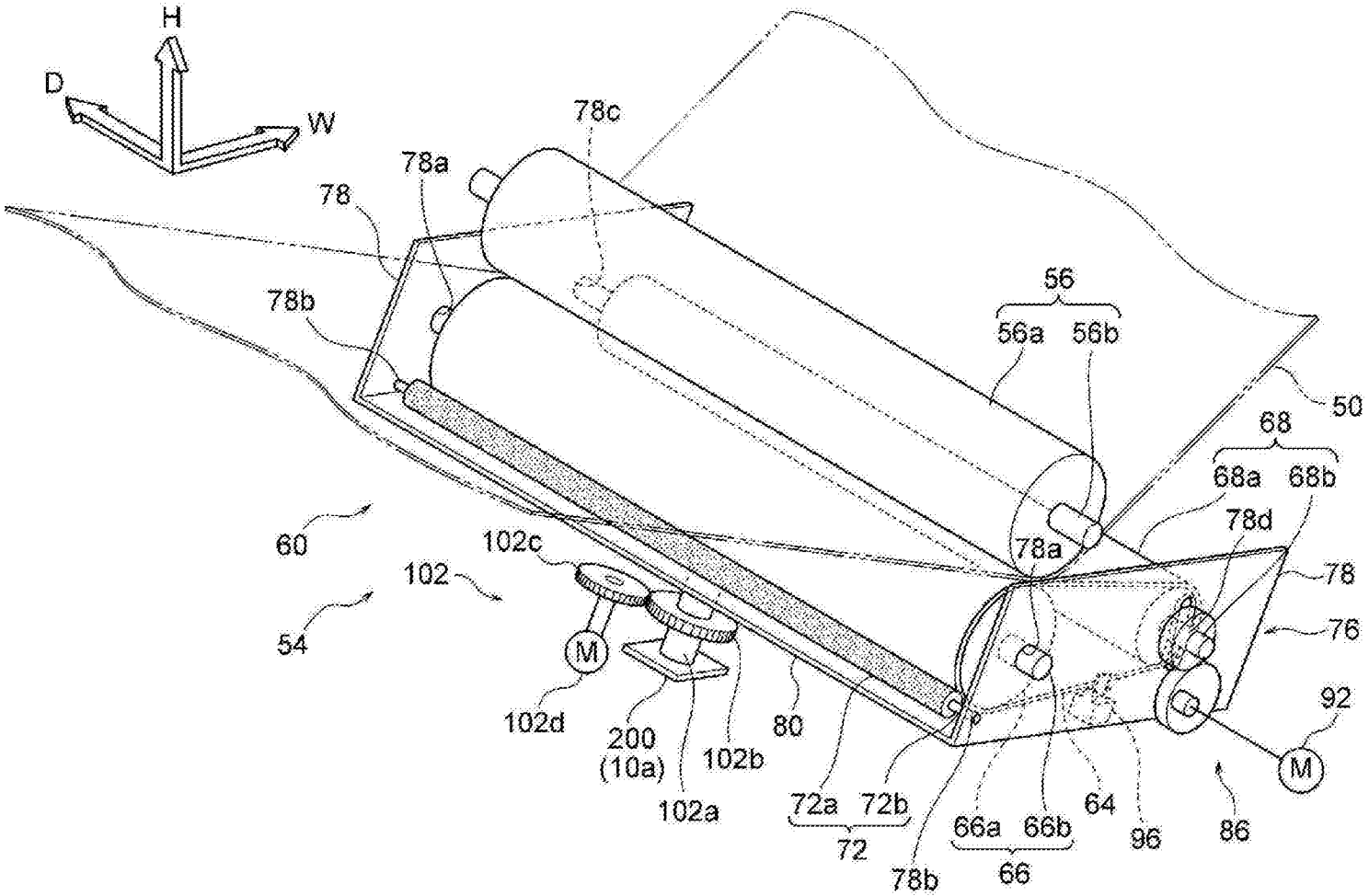
FIG. 1 is a perspective view illustrating, for example, a secondary transfer unit of a transfer device according to a first exemplary embodiment of the present disclosure.

As illustrated in FIG. 1, the secondary transfer unit 54 is disposed on the opposite side of the winding roller 56 with the transfer belt 50 interposed therebetween. Then, the secondary transfer unit 54 includes a transfer unit 60, a tilting unit 86 that tilts an assist roller 68 provided in the transfer unit 60, and a sensor 96 that detects the position of an elastic belt 64 provided in the transfer unit 60. The secondary transfer unit 54 is an example of a transfer unit. The tilting unit 86 is an example of another adjustment unit.

[Transfer Unit 60]

The transfer unit 60 includes the secondary transfer roller 66, the assist roller 68, the endless elastic belt 64 wound around the secondary transfer roller 66 and the assist roller 68, and a cleaning roller 72 that cleans the outer peripheral surface of the elastic belt 64. In addition, the transfer unit 60 includes a support member 76 that supports the secondary transfer roller 66, the assist roller 68, and the cleaning roller 72. The secondary transfer roller 66 is an example of a transfer roller. The elastic belt 64 is an example of an endless belt.

—Secondary Transfer Roller 66—

The secondary transfer roller 66 is electrically grounded. As illustrated in FIG. 1, the axial direction of the secondary transfer roller 66 is the apparatus depth direction. The secondary transfer roller 66 is disposed on the opposite side of the winding roller 56 with the transfer belt 50 and the elastic belt 64 interposed therebetween. The secondary transfer roller 66 includes a cylindrical main body portion 66*a* formed of an elastic member and a shaft portion 66*b* penetrating the inside of the main body portion 66*a*. The outer diameter of the main body portion 66*a* is the same as the outer diameter of the main body portion 56*a* of the winding roller 56. The axial length of the main body portion 66*a* is the same as the axial length of the main body portion 56*a* of the winding roller 56.

—Assist Roller 68—

As illustrated in FIG. 1, the axial direction of the assist roller 68 is the apparatus depth direction. The assist roller 68 is disposed downstream of the secondary transfer roller 66 in the direction in which the sheet member P is transported (hereinafter referred to as "sheet transport direction") so as to be separated from the secondary transfer roller 66. The assist roller 68 includes a cylindrical main body portion 68*a* formed of a metal and a pair of shaft portions 68*b* protruding from both ends of the main body portion 68*a* in the apparatus depth direction. The outer diameter of the main body portion 68*a* is less than the outer diameter of the main body portion 66*a* of the secondary transfer roller 66. The axial length of the main body portion 68*a* is the same as the axial length of the main body portion 66*a* of the secondary transfer roller 66.

—Cleaning Roller 72—

As illustrated in FIG. 1, the axial direction of the cleaning roller 72 is the apparatus depth direction. The cleaning roller 72 is disposed on the opposite side of the secondary transfer roller 66 with the elastic belt 64 interposed therebetween. The cleaning roller 72 includes a brush-shaped main body portion 72*a* and a pair of shaft portions 72*b* protruding from both ends of the main body portion 72*a* in the apparatus depth direction. The axial length of the main body portion 72*a* is the same as the axial length of the main body portion 66*a* of the secondary transfer roller 66 and the length of the elastic belt 64 in the width direction.

—Support Member 76—

The support member 76 is formed by bending a trimmed sheet metal. As illustrated in FIG. 1, the support member 76 includes a pair of side plates 78 each having a plate surface facing the apparatus depth direction and a bottom plate 80 disposed below the winding roller 56 to interconnect the pair of side plates 78.

The elastic belt 64 is sandwiched between the pair of side plates 78 in the apparatus depth direction. Circular through holes 78*a* which constitute bearings are formed respectively in the pair of side plates 78. The shaft portion 66*b* of the secondary transfer roller 66 passes through the circular through holes 78*a*. Thus, the secondary transfer roller 66 is rotatably supported by the support member 76.

Further, circular through holes 78*b* which constitutes bearings are formed respectively in the pair of side plates 78. The shaft portions 72*b* of the cleaning roller 72 pass through the circular through holes 78*b*. Thus, the cleaning roller 72 is rotatably supported by the support member 76.

Figure 4B:
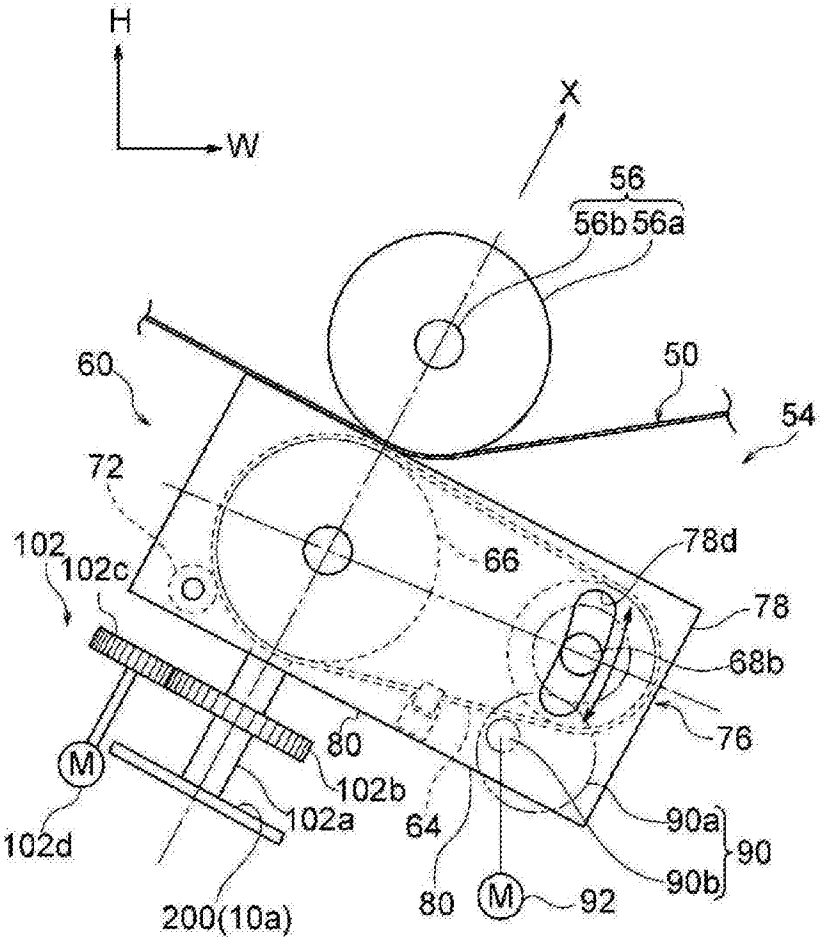
FIGS. 4A and 4B are side views illustrating the secondary transfer unit of the transfer device according to the first exemplary embodiment of the present disclosure.

In addition, through holes 78*c* and 78*d* through which the shaft portions 68*b* of the assist roller 68 pass are formed respectively in the pair of side plates 78. The circular through hole 78*c* is formed in the side plate 78 on the back side in the apparatus depth direction, and the elongated through hole 78*d* (see FIG. 4B) in which the shaft portion 68*b* is movable is formed in the side plate 78 on the front side in the apparatus depth direction. Specifically, as illustrated in FIG. 4B, the through hole 78*d* takes the form of an arc centered on the axis of the secondary transfer roller 66 when viewed from the apparatus depth direction. Then, the axial direction of the assist roller 68 is adapted to follow the axial direction of the secondary transfer roller 66 when the shaft portion 68*b* which is a portion on the front side in the apparatus depth direction is disposed in the central portion in the circumferential direction of the arc-shaped through hole 78*d*.

[Tilting Unit 86]

Figure 3:
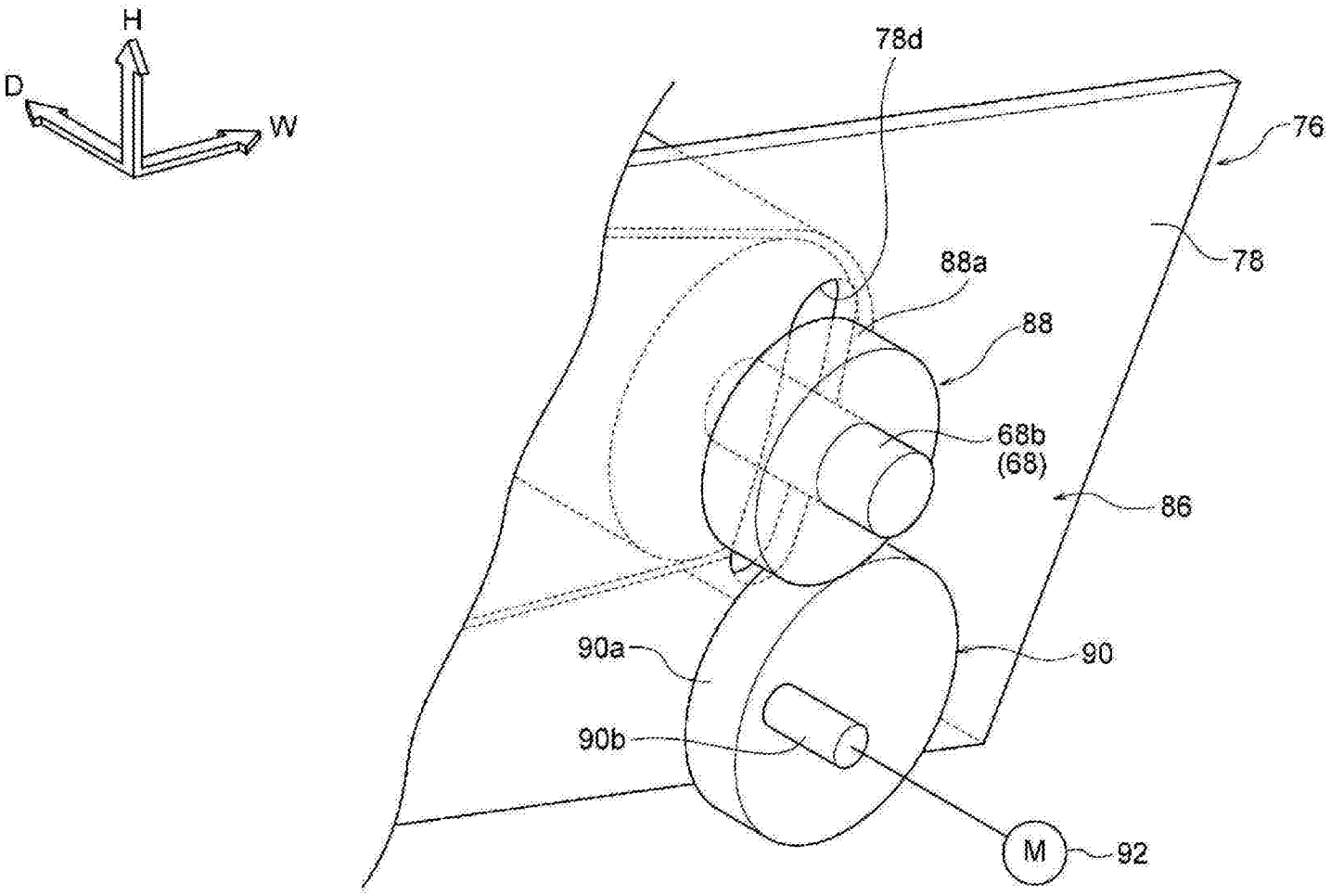
FIG. 3 is an enlarged perspective view illustrating the secondary transfer unit of the transfer device according to the first exemplary embodiment of the present disclosure.

As illustrated in FIGS. 1 and 3, the tilting unit 86 is disposed on a portion on the front side of the shaft portions 68*b* of the assist roller 68 in the apparatus depth direction.

The titling unit 86 includes a disk-shaped bearing 88 which supports the shaft portion 68*b* of the assist roller 68, an eccentric cam 90 having a cam surface in contact with the outer peripheral surface of the bearing 88, and a stepping motor 92 (hereinafter referred to as "motor 92") which rotates the eccentric cam 90.

—Bearing 88—

As described above, the bearing 88 has a disk shape and supports the portion on the front side of the shaft portions 68*b* of the assist roller 68 in the apparatus depth direction. Then, the bearing 88 is formed with an outer peripheral surface 88*a*.

—Eccentric Cam 90—

The eccentric cam 90 is disposed below the bearing 88, and includes a cam surface 90*a* in contact with the outer peripheral surface 88*a* of the bearing 88 and a rotary shaft 90*b* rotatably supported by the side plate 78.

—Motor 92—

The motor 92 is adapted to rotate the eccentric cam 90 about the axis of the rotary shaft 90*b*.

Figure 8A:
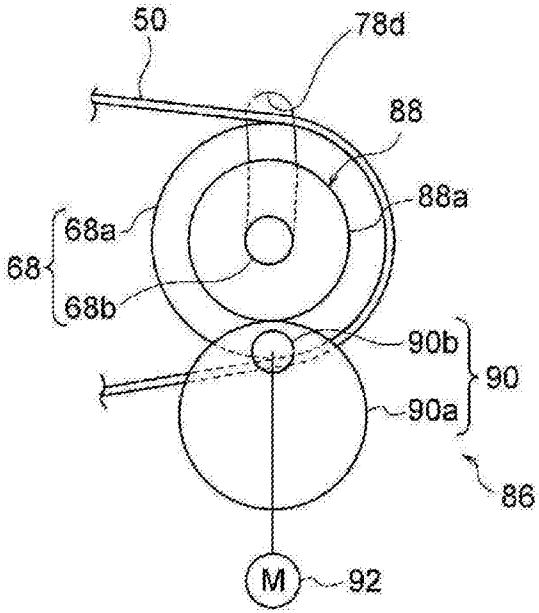
FIGS. 8A, 8B and 8C are views illustrating an operation of a tilting unit of the transfer device according to the first exemplary embodiment of the present disclosure.
Figure 8B:
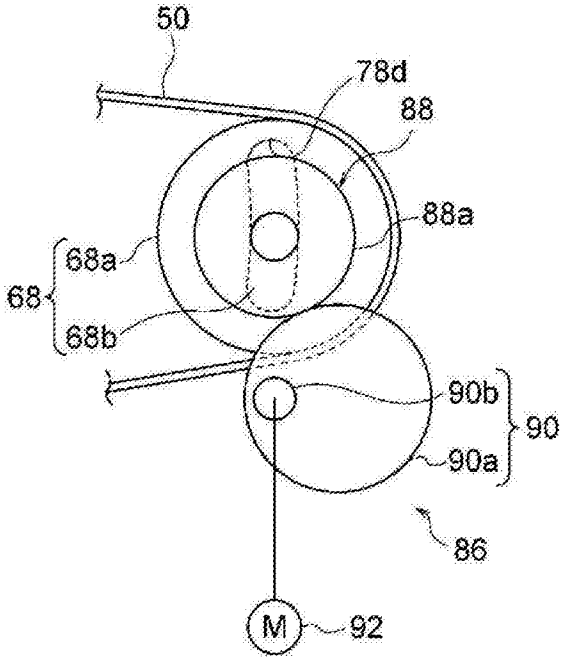
Figure 8C:
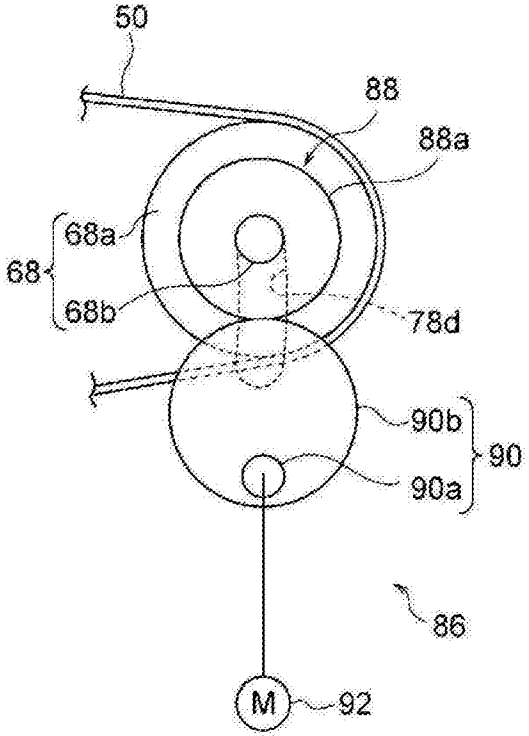
Figure 9A:
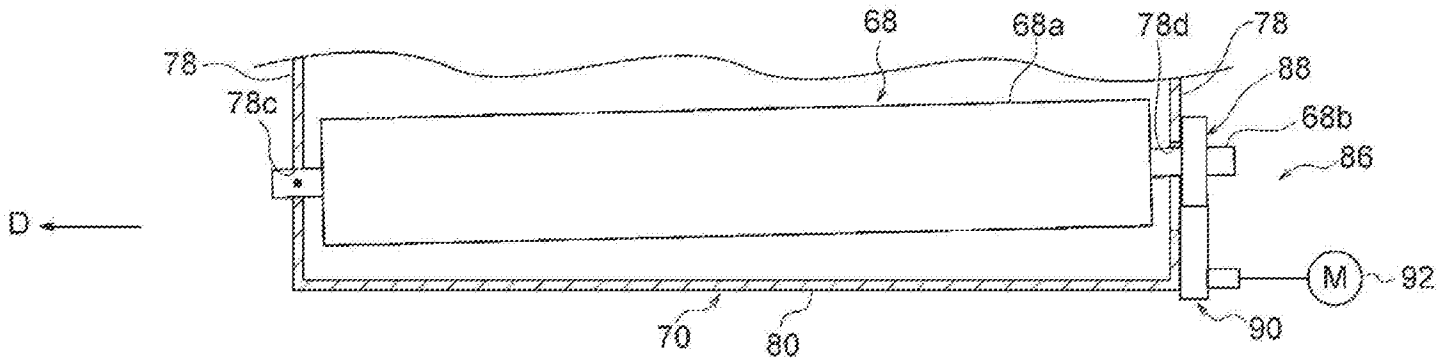
FIGS. 9A, 9B and 9C are views illustrating an operation of an assist roller and the tilting unit of the transfer device according to the first exemplary embodiment of the present disclosure.
Figure 9B:
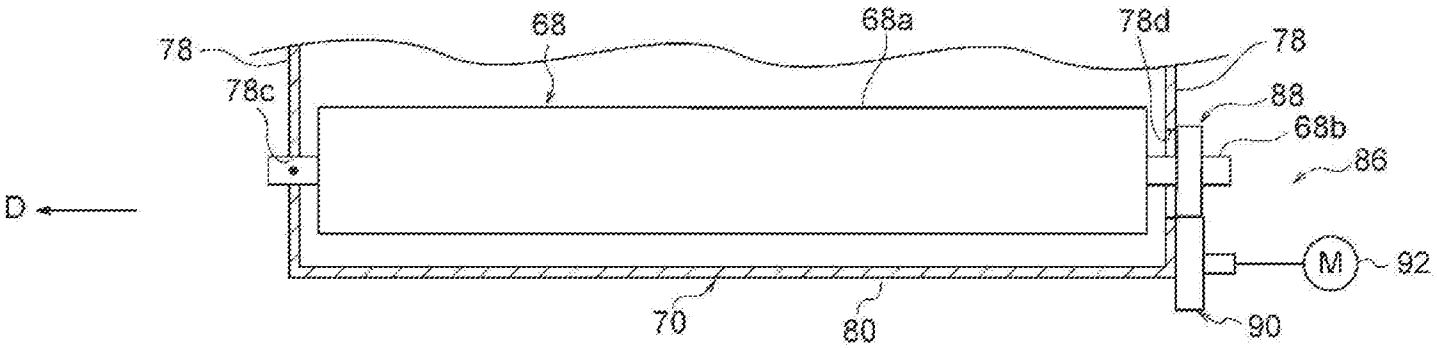
Figure 9C:
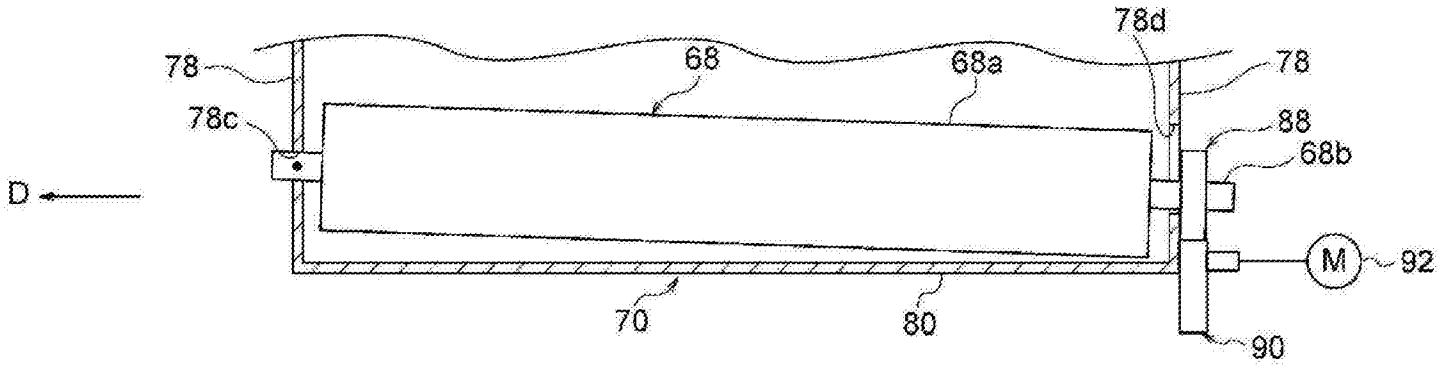

In the above configuration, when the motor 92 rotates the eccentric cam 90, as illustrated in FIGS. 8A, 8B and 8C, the portion on the front side of the shaft portions 68*b* of the assist roller 68 in the apparatus depth direction moves in the through hole 78*d* formed in the side plate 78. Thus, as illustrated in FIGS. 9A, 9B and 9C, the assist roller 68 rotates about the portion on the back side of the shaft portions 68*b* of the assist roller 68 in the apparatus depth direction, and is tilted with respect to the apparatus depth direction. In other words, as illustrated in FIGS. 9A, 9B and 9C, the assist roller 68 rotates about the portion on the back side of the shaft portions 68*b* of the assist roller 68 in the apparatus depth direction, and is tilted with respect to the axial direction of the secondary transfer roller 66. In this way, the tilting unit 86 functions as a direction variation unit that makes the axial direction of the assist roller 68 different from the axial direction of the secondary transfer roller 66.

[Sensor 96]

Figure 2:
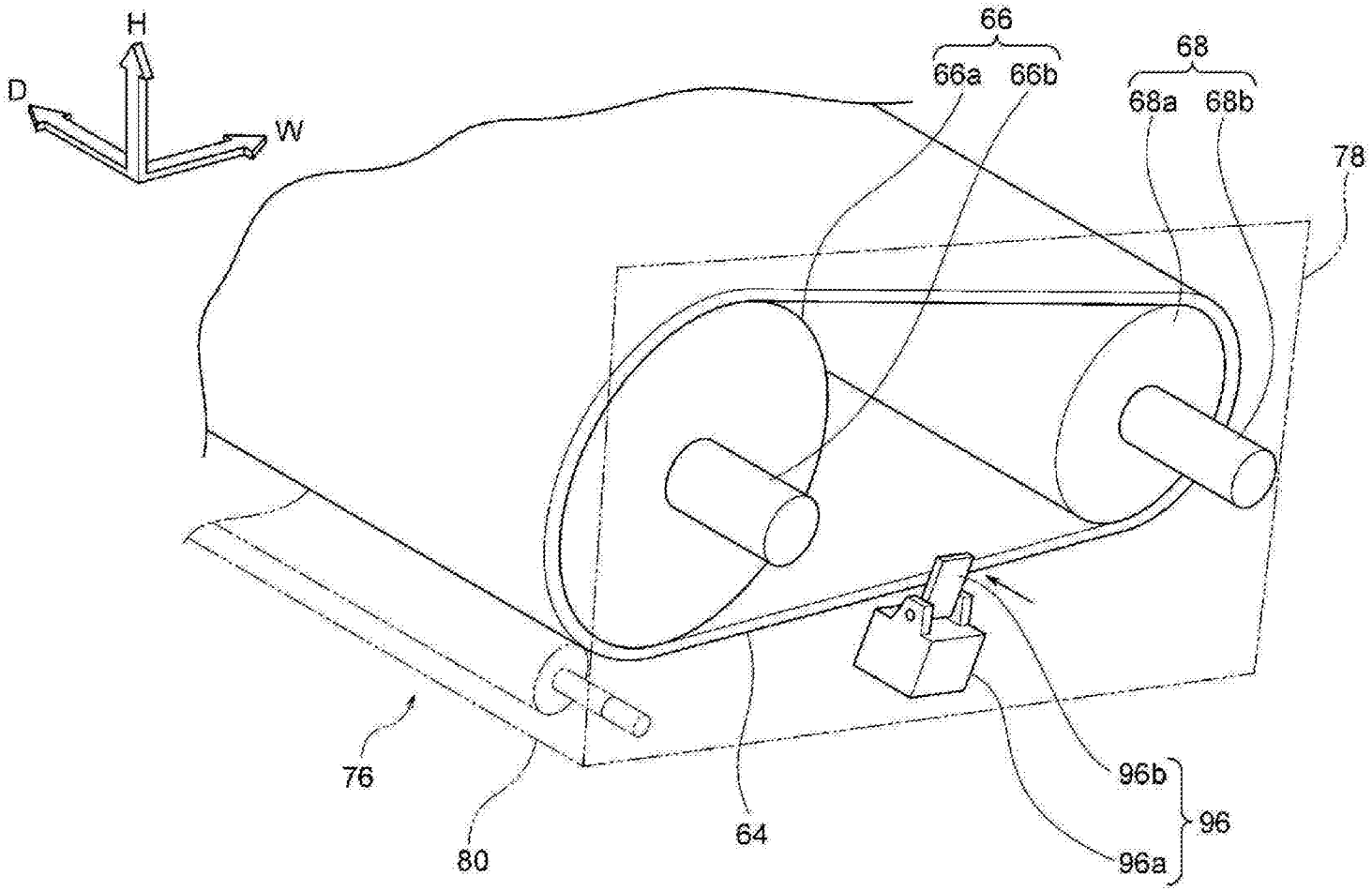
FIG. 2 is an enlarged perspective view illustrating the secondary transfer unit of the transfer device according to the first exemplary embodiment of the present disclosure.

As illustrated in FIG. 2, the sensor 96 is disposed in front of the elastic belt 64 in the apparatus depth direction, and is mounted to the bottom plate 80 of the support member 76. The sensor 96 includes a main body portion 96*a* and a swinging portion 96*b* mounted to the main body portion 96*a* so as to swing relative to the main body portion 96*a*.

The swinging portion 96*b* has a flat plate shape. The swinging portion 96*b* is biased by a biasing member (not illustrated), and the plate surface of the swinging portion 96*b* is in contact with the end surface of the elastic belt 64 in the apparatus depth direction.

Figure 7C:
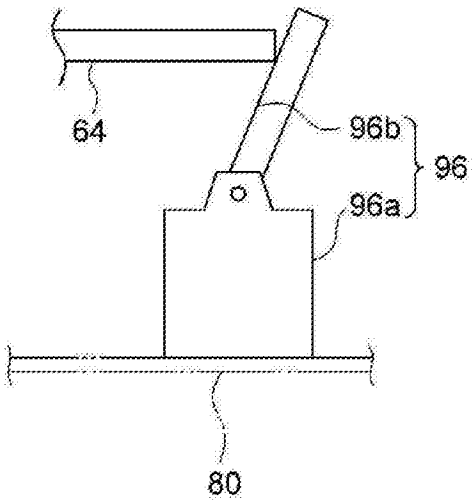
FIGS. 7A, 7B and 7C are views illustrating an operation of a sensor of the transfer device according to the first exemplary embodiment of the present disclosure.
Figure 7B:
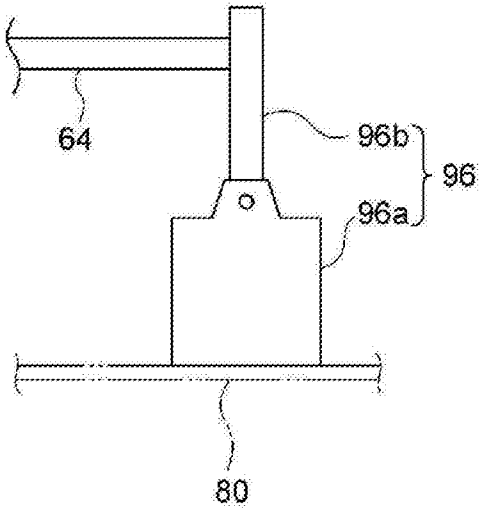
Figure 7A:
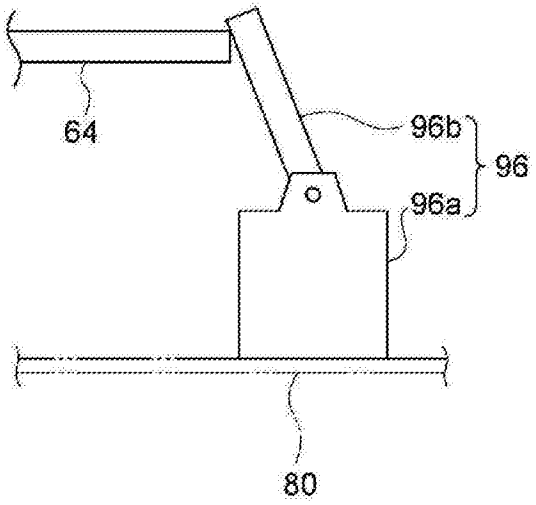

In this configuration, as illustrated in FIGS. 7A, 7B and 7C, when the elastic belt 64 moves in the apparatus depth direction (so-called belt walk), the degree of swinging of the swinging portion 96*b* also changes. Thus, the sensor 96 is adapted to detect the position of the elastic belt 64 in the apparatus depth direction (that is, the width direction of the elastic belt 64).

[Adjustment Unit 102]

Next, the adjustment unit 102 which rotates the secondary transfer unit 54 will be described.

Figure 4A:
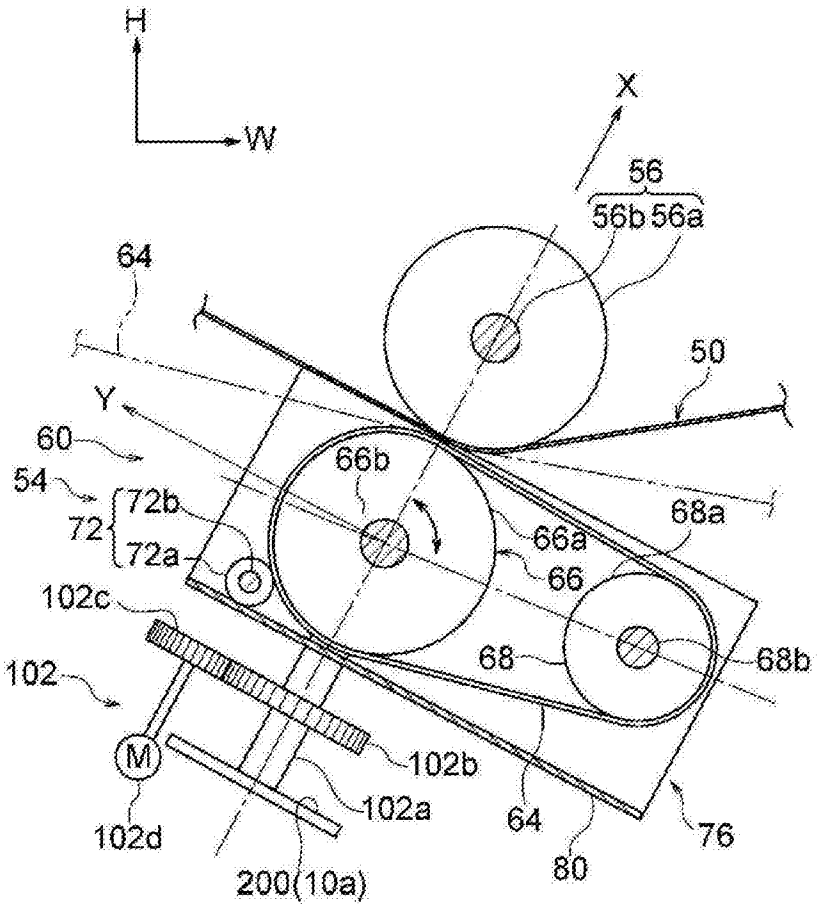

As illustrated in FIGS. 4A and 4B, the adjustment unit 102 is disposed on the opposite side of the secondary transfer roller 66 with the bottom plate 80 of the support member 76 interposed therebetween when viewed from the apparatus depth direction. The adjustment unit 102 includes a shaft portion 102*a*, a gear 102*b* mounted to the shaft portion 102*a*, a gear 102*c* meshing with the gear 102*b*, and a stepping motor 102*d* (hereinafter referred to as "motor 102*d*") which applies rotational force to the gear 102*c*.

[Shaft Portion 102*a*]

As illustrated in FIG. 4A, the axial direction of the shaft portion 102*a* is the direction in which a straight line extends that passes through the axial center portion of the shaft portion 56*b* of the winding roller 56 and the axial center portion of the shaft portion 66*b* of the secondary transfer roller 66 (that is, the X direction in the drawing) when viewed in the apparatus depth direction.

Figure 5:
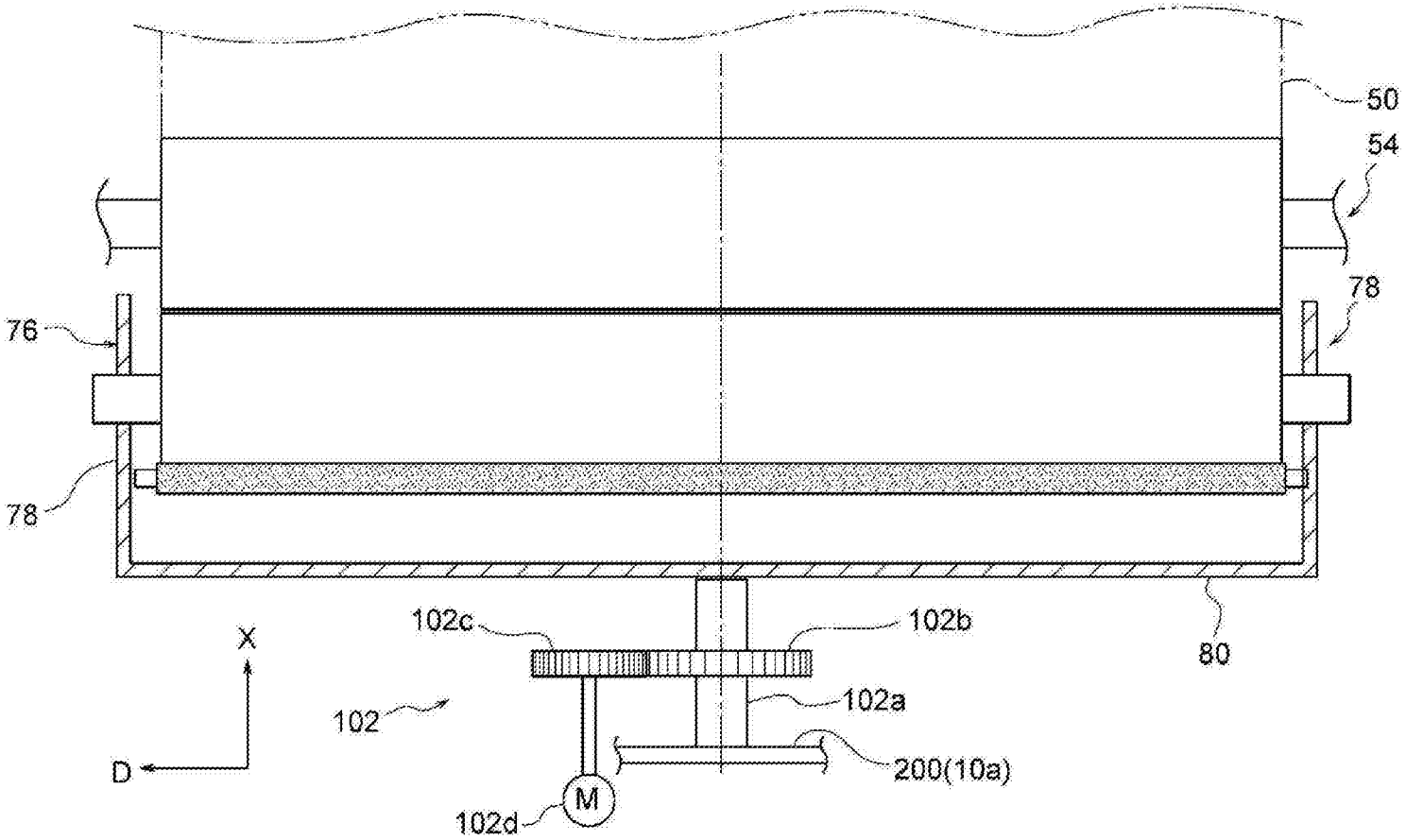
FIG. 5 is a front view illustrating the secondary transfer unit of the transfer device according to the first exemplary embodiment of the present disclosure.

In addition, the axial direction of the shaft portion 102*a* passes through the axis of the secondary transfer roller 66, and as illustrated in FIG. 5, extends in the X direction when viewed from the Y direction orthogonal to the X direction. Further, the upper end of the shaft portion 102*a* is mounted to the center portion of the bottom plate 80 of the support member 76 in the apparatus depth direction. In addition, the lower end of the shaft portion 102*a* is mounted to a frame member 200 provided in an apparatus main body 10*a*, and the shaft portion 102*a* is rotatable around the axis thereof.

[Gear 102*b*, Gear 102*c*, and Motor 102*d*]

As illustrated in FIG. 5, the gear 102*b* is mounted to the shaft portion 102*a*, and the gear 102*c* meshes with the gear 102*b*. In addition, the motor 102*d* is provided to apply rotational force to the gear 102*c*. The motor 102*d* is an example of a drive unit.

In the above configuration, when the motor 102*d* applies rotational force to the gear 102*c*, the rotational force is transmitted to the shaft portion 102*a* via the gear 102*b*. Thus, when the shaft portion 102*s* rotates, the secondary transfer nit 54 rotates. In this way, the adjustment unit 102 rotates the secondary transfer unit 54 around the axis of the shaft portion 102*a*. In other words, the adjustment unit 102 changes the transport direction of the sheet member P transported by the secondary transfer roller 66 provided in the secondary transfer unit 54.

Further, when the secondary transfer unit 54 rotates, the secondary transfer roller 66 also rotates. In this way, the adjustment unit 102 functions as an axis rotation unit that rotates the axis of the secondary transfer roller 66.

Figure 6A:
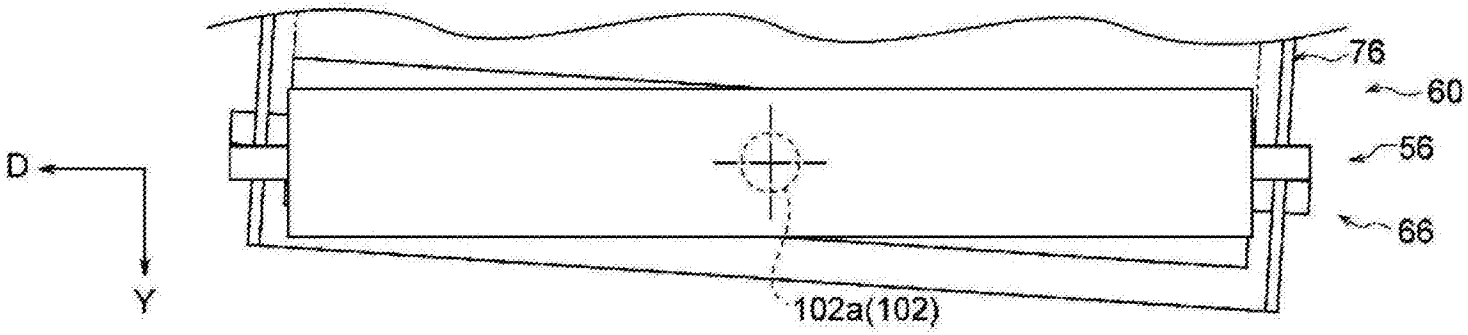
FIGS. 6A, 6B and 6C are plan views illustrating the secondary transfer unit of the transfer device according to the first exemplary embodiment of the present disclosure.
Figure 6B:
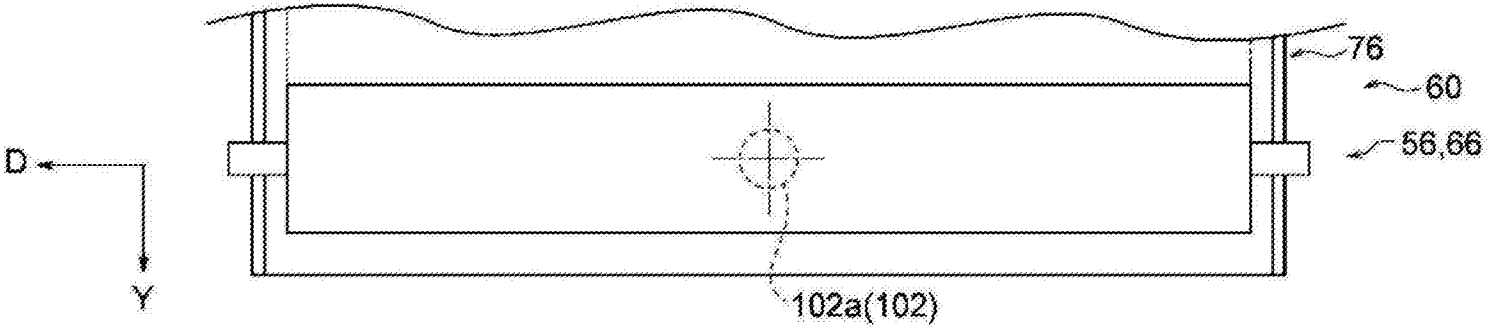
Figure 6C:
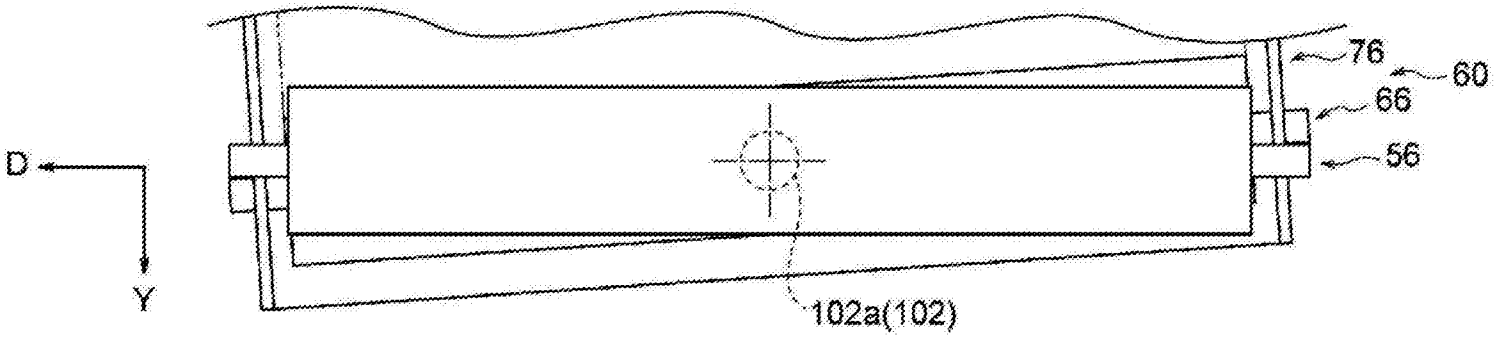

Thus, as illustrated in FIGS. 6A, 6B and 6C, when the axis of the secondary transfer roller 66 rotates, the parallelism (that is, roller parallel alignment) between the axis of the secondary transfer roller 66 and the axis of the winding roller 56 is adjusted when viewed from the X direction. That is, "adjust the parallelism" means that the direction of the axis of the secondary transfer roller 66 approaches the direction of the axis of the winding roller 56 via rotation of the axial direction of at least one of the axis of the secondary transfer roller 66 or the axis of the assist roller 68.

[Controller 106]

Figure 14:
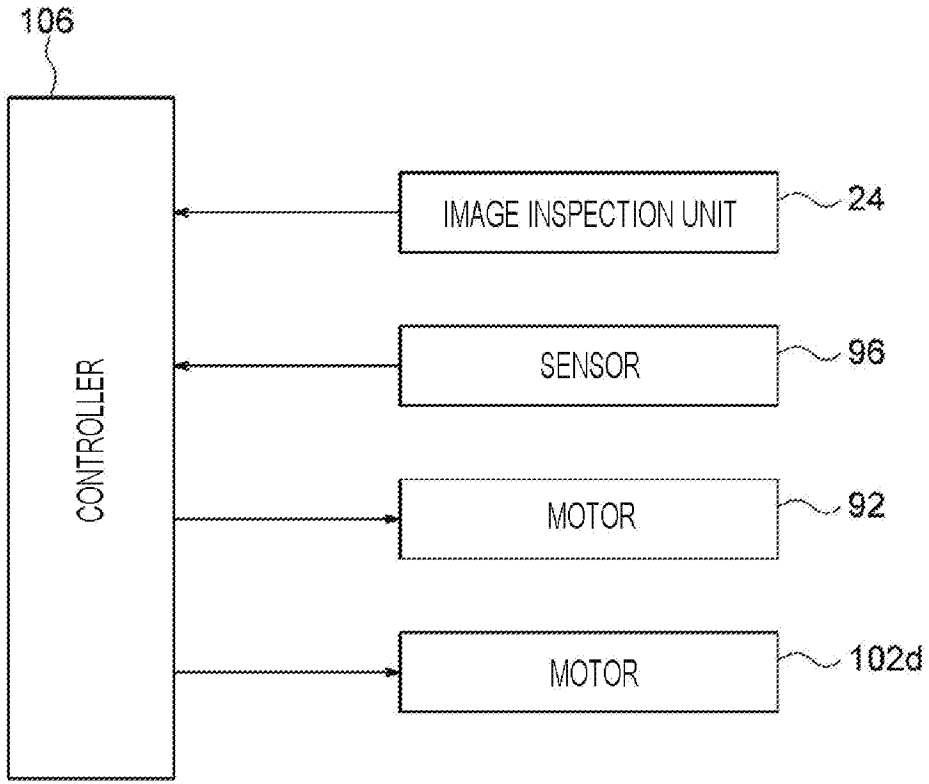
FIG. 14 is a block diagram illustrating a control system of a controller provided in the transfer device according to the first exemplary embodiment of the present disclosure.

As illustrated in FIG. 14, the controller 106 is adapted to control the motor 92 based on detection information of the sensor 96 and to control the motor 102*d* based on the detection result of the image inspection unit 24. The control of each unit by the controller 106 will be described along with an action to be described later. [Image Inspection Unit 24]

As illustrated in FIG. 17, the image inspection unit 24 is disposed downstream of the transfer nip NT which transfers the toner image to the sheet member P in the sheet transport direction. The image inspection unit 24 is an example of a detector.

Figure 12:
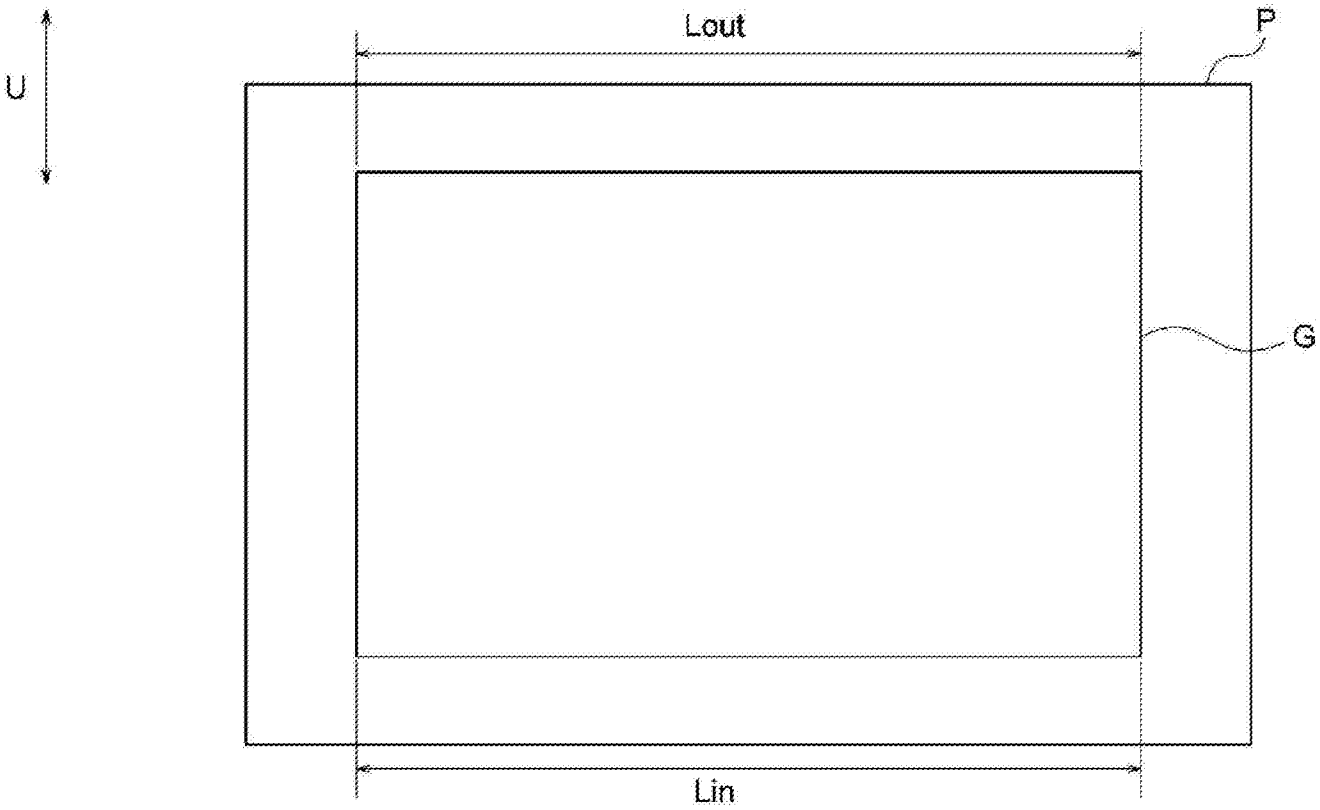
FIG. 12 is an explanatory view used to describe the process of detecting image parallelism in the transfer device according to the first exemplary embodiment of the present disclosure.

The image inspection unit 24 has a function of detecting the image parallelism of the image formed on the sheet member P. The image parallelism is, as illustrated in FIG. 12, the degree of parallelism of the image with respect to the width direction of the sheet member P (the direction of the arrow U in the drawing). Then, the image parallelism is indicated by the difference ΔL (=Lout−Lin) between the line image length Lout at one end and the line image length Lin at the other end, in the width direction, of an image forming area G on the sheet member P.

Figure 10:
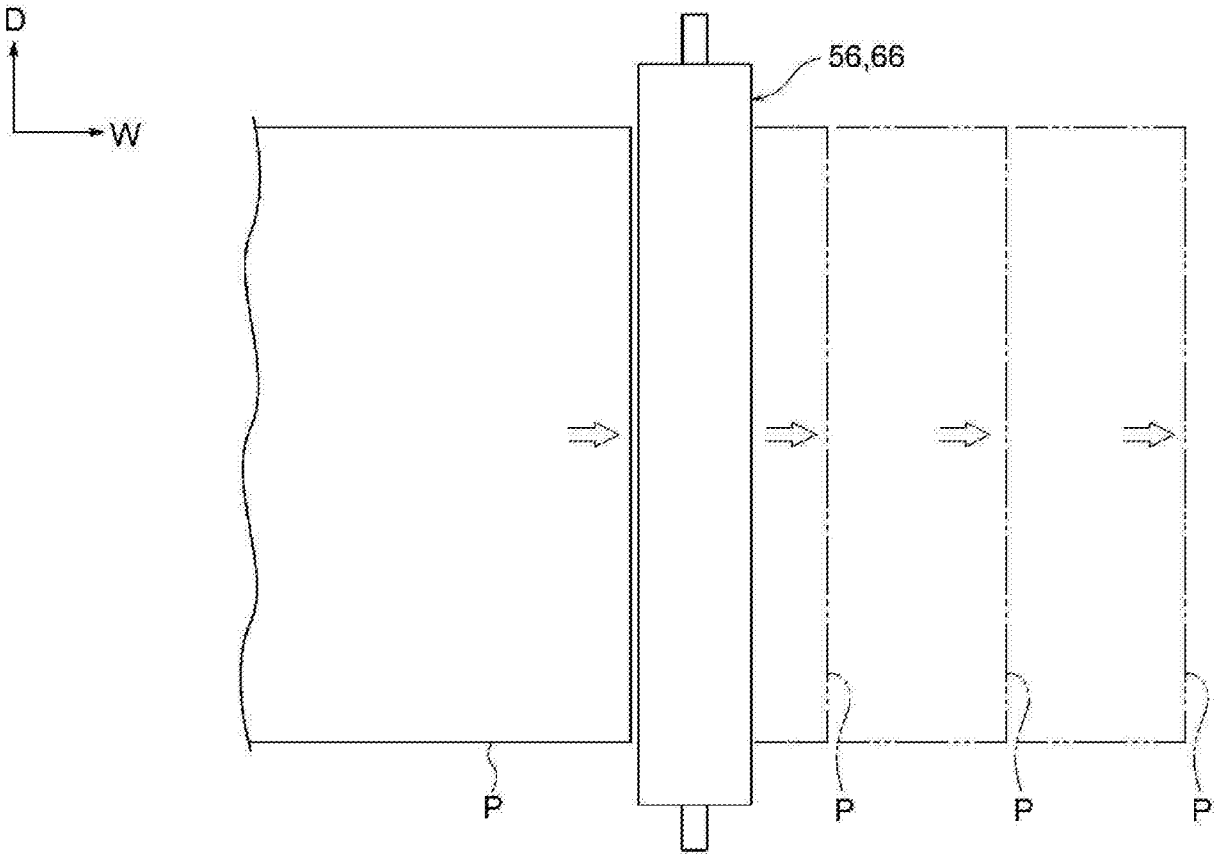
FIG. 10 is an explanatory view used to describe a process of detecting image parallelism in the transfer device according to the first exemplary embodiment of the present disclosure.

For example, when the parallelism between the axis of the secondary transfer roller 66 and the axis of the winding roller 56 falls within a predetermined reference value, as illustrated in FIG. 10, the transport direction of the sheet member P to be transported does not change even if the sheet member P passes between the secondary transfer roller 66 and the winding roller 56. In this case, as illustrated in FIG. 12, "ΔL" falls within a predetermined value, and the image parallelism falls within a reference value.

Figure 11:
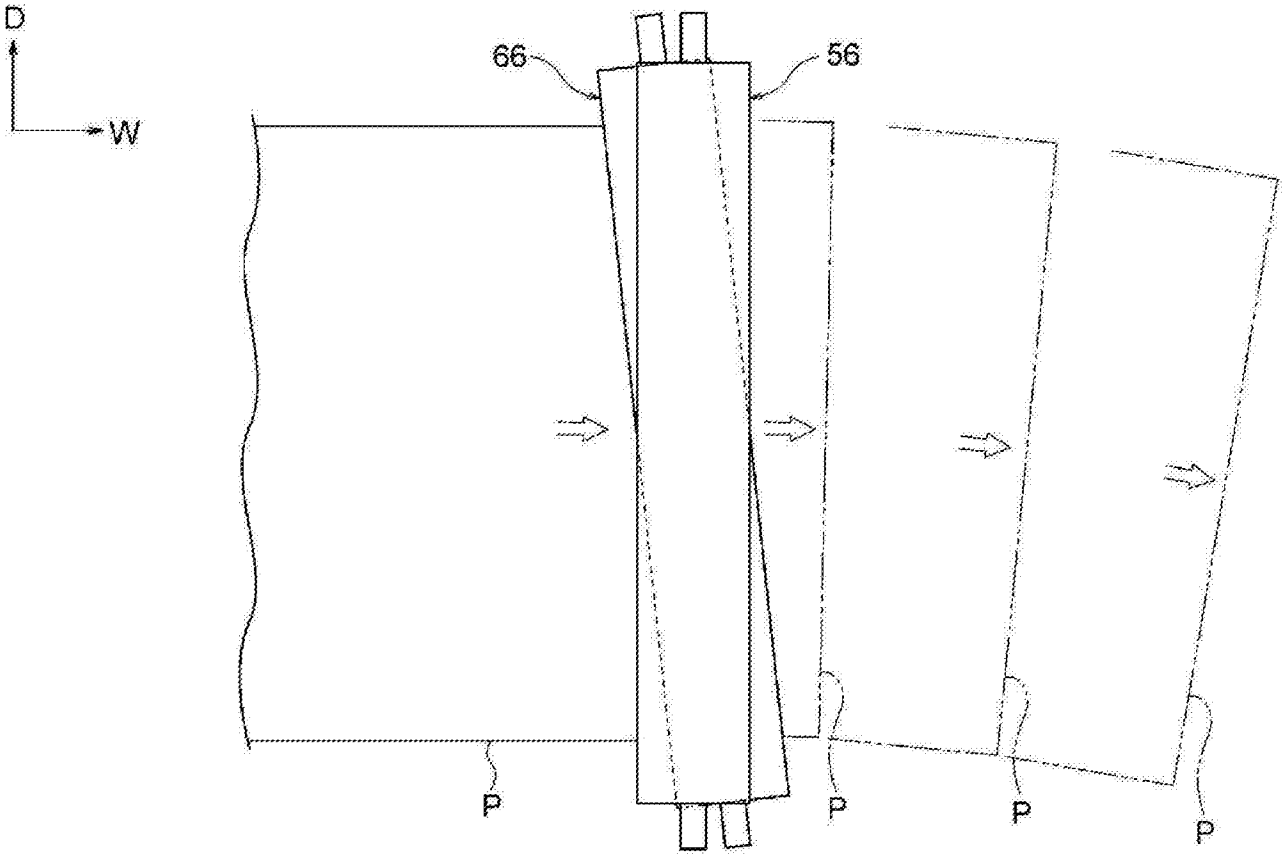
FIG. 11 is an explanatory view used to describe the process of detecting image parallelism in the transfer device according to the first exemplary embodiment of the present disclosure.
Figure 13:
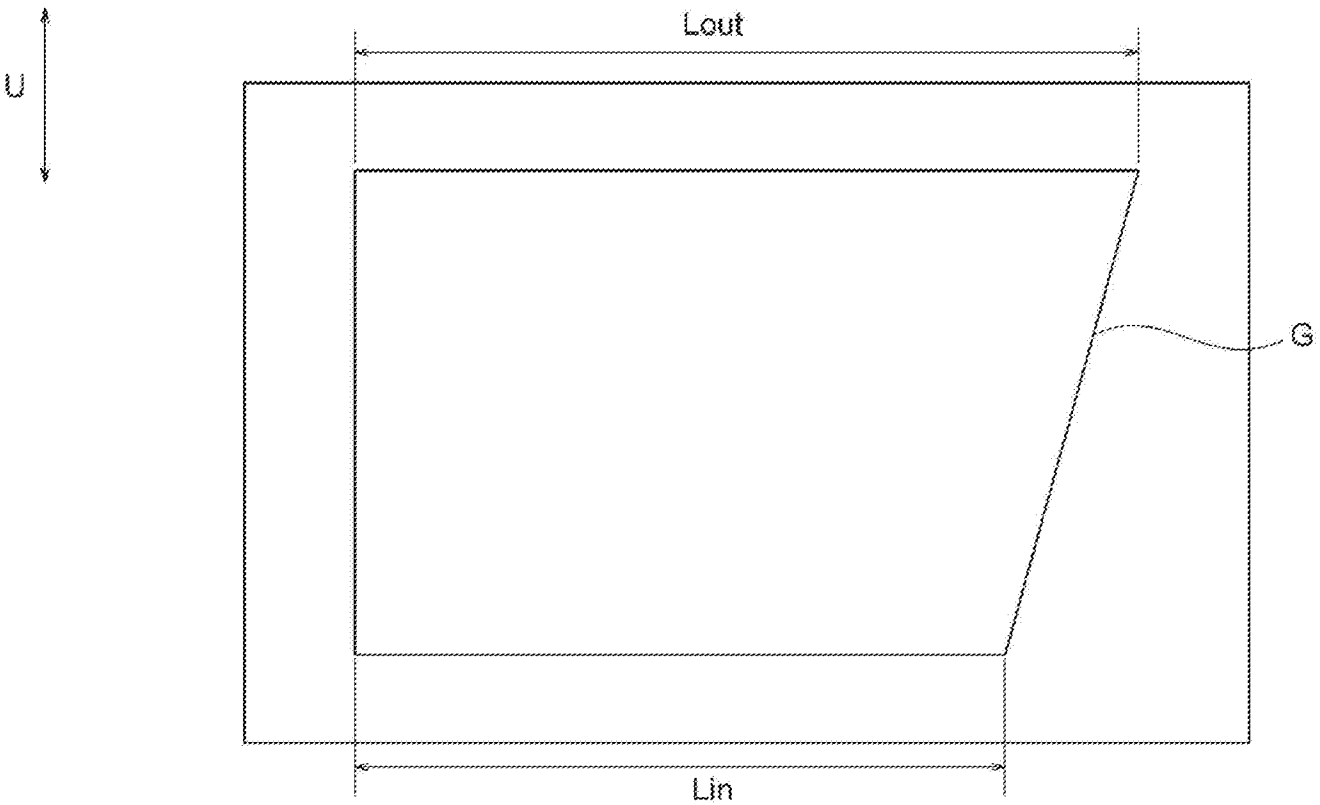
FIG. 13 is an explanatory view used to describe the process of detecting image parallelism in the transfer device according to the first exemplary embodiment of the present disclosure.

On the other hand, when the parallelism between the axis of the secondary transfer roller 66 and the axis of the winding roller 56 does not satisfy a predetermined reference, as illustrated in FIG. 11 the transport direction of the sheet member P to be transported may change by passing between the secondary transfer roller 66 and the winding roller 56. In this case, as illustrated in FIG. 13, "ΔL" does not satisfy a predetermined reference, and the image parallelism does not satisfy a reference. In FIG. 11, the degree of change in the transport direction is illustrated exaggeratingly, and in FIG. 13, the degree to which the image parallelism does not satisfy a reference is illustrated exaggeratingly.

(Action of Major Component)

Next, action of the transfer device 38, for example, will be described in comparison with a transfer device 538 provided in an image forming apparatus 510 according to a comparative example. As for the transfer device 538 according to the comparative example, parts different from those in the transfer device 38 will be mainly described.

[Configuration of Transfer Device 538]

Figure 18:
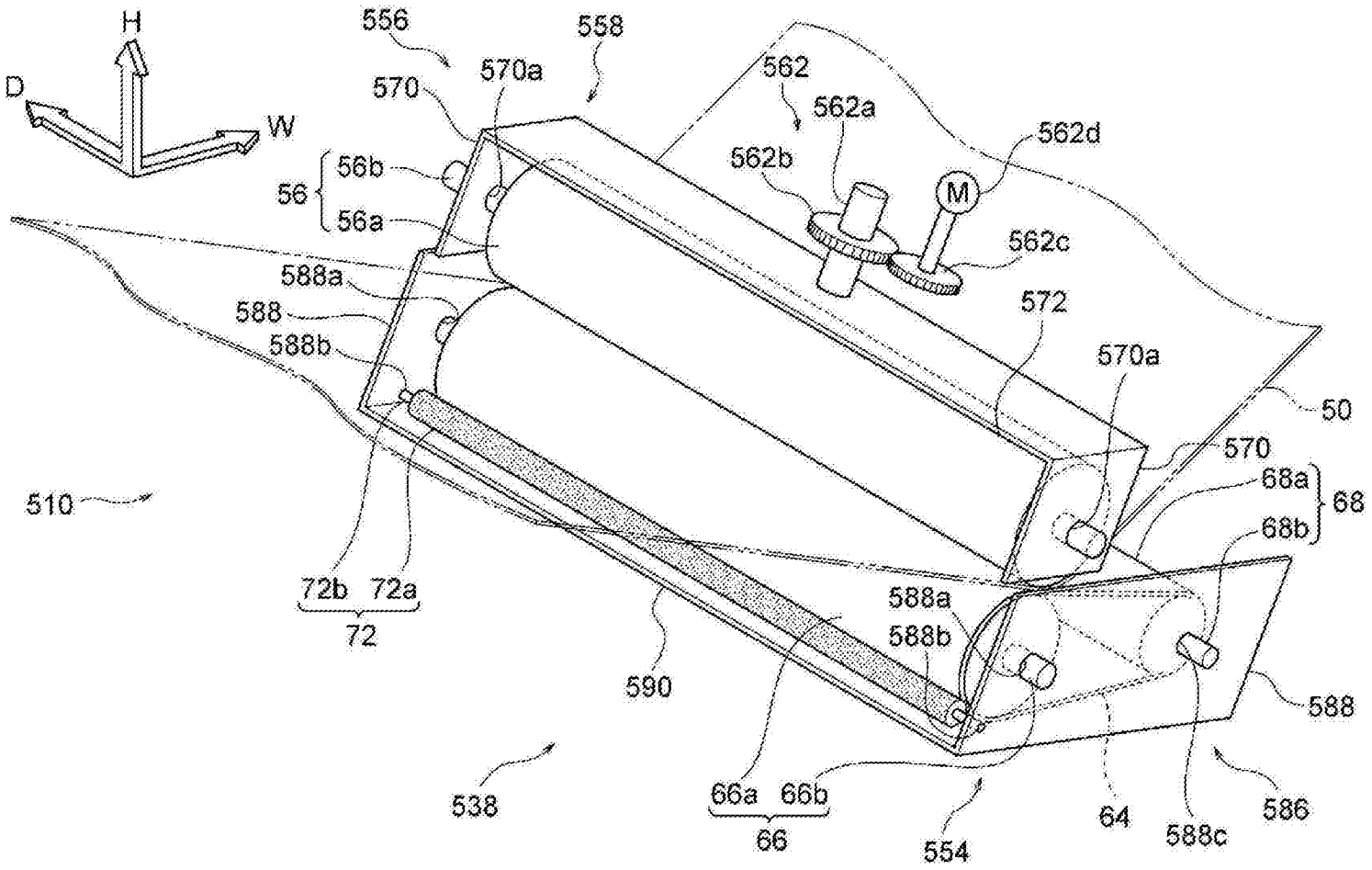
FIG. 18 is a perspective view illustrating, for example, a secondary transfer unit of a transfer device according to a comparative example with respect to the first exemplary embodiment of the present disclosure.
Figure 19:
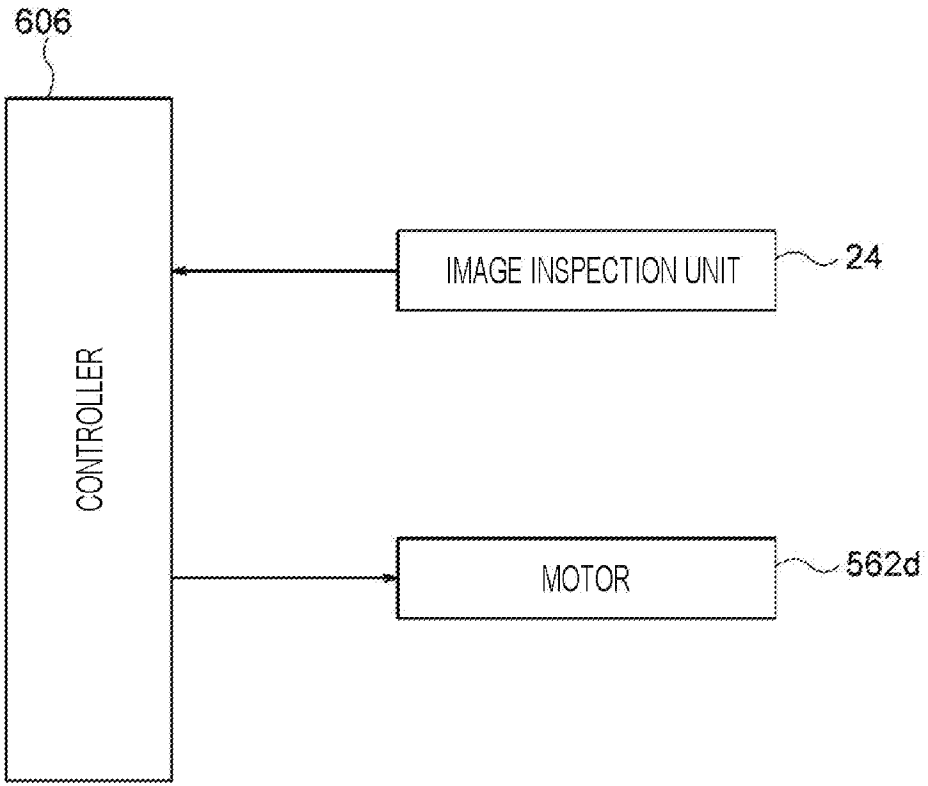
FIG. 19 is a block diagram illustrating a control system of a controller provided in the transfer device according to the comparative example with respect to the first exemplary embodiment of the present disclosure.

The transfer device 538 according to the comparative example includes the transfer belt 50, the primary transfer roller 52, and a controller 606 (see FIG. 19). In addition, as illustrated in FIG. 18, the transfer device 538 includes a winding section 556 provided with the winding roller 56 and a secondary transfer unit 554 provided with the secondary transfer roller 66. The transfer device 538 is not provided with an adjustment unit which rotates the secondary transfer unit.

—Winding Section 556—

The winding section 556 includes the winding roller 56, a support member 558 which rotatably supports the winding roller 56, and an adjustment unit 562 which changes the axis of the winding roller 56 by rotating the support member 558 and adjusts the parallelism between the axis of the secondary transfer roller 66 and the axis of the winding roller 56.

The support member 558 is formed by bending a trimmed sheet metal, and includes a pair of side plates 570 each having a plate surface facing the apparatus depth direction and a top plate 572 disposed on the opposite side of the transfer belt 50 with the winding roller 56 interposed therebetween to interconnect the pair of side plates 570. Then, the pair of side plates 570 sandwich therebetween the main body portion 56*a* of the winding roller 56 in the apparatus depth direction, and through holes 570*a* through which the shaft portion 56*b* of the winding roller 56 passes are formed respectively in the pair of side plates 570.

The adjustment unit 562 includes a shaft portion 562*a* rotatably supported by the apparatus main body, a gear 562*b* mounted to the shaft portion 562*a*, a gear 562*c* meshing with the gear 562*b*, and a stepping motor 562*d* (hereinafter referred to as "motor 562*d*") which applies rotational force to the gear 562*c*.

One end of the shaft portion 562*a* is mounted to the center portion of the top plate 572 in the apparatus depth direction, and the axial direction of the shaft portion 562*a* is the direction in which a straight line which passes through the axis of the winding roller 56 and the axis of the secondary transfer roller 66 extends when viewed from the apparatus depth direction.

—Secondary Transfer Unit 554—

The secondary transfer unit 554 includes the secondary transfer roller 66, the assist roller 68, the elastic belt 64, and the cleaning roller 72, In addition, the secondary transfer unit 554 includes a support member 586.

The support member 586 is formed by bending a trimmed sheet metal, and includes a pair of side plates 588 each having a plate surface facing the apparatus depth direction and a bottom plate 590 disposed on the opposite side of the winding roller 56 with the elastic belt 64 interposed therebetween to interconnect the pair of side plates 588.

The pair of side plates 588 sandwich the elastic belt 64 in the apparatus depth direction, and circular through holes 588*a* through which the shaft portion 66*b* of the secondary transfer roller 66 passes are formed respectively in the pair of side plates 588. Thus, the secondary transfer roller 66 is rotatably supported by the support member 586. Further, circular through holes 588*b* through which the shaft portions 72*b* of the cleaning roller 72 pass are formed respectively in the pair of side plates 588. Thus, the cleaning roller 72 is rotatably supported by the support member 586. Furthermore, circular through holes 588*c* through which the shaft portions 68*b* of the assist roller 68 pass are formed respectively in the pair of side plates 588. Thus, the assist roller 68 is rotatably supported by the support member 586.

Furthermore, the secondary transfer unit 554 is not provided with a tilting unit which tilts the assist roller 68.

[Action of Transfer Device 38 or 538]

In the transfer device 38 or 538, the toner images formed by the toner image forming units 30V, 30Y, 30M, 30C and 30K illustrated in FIG. 15 are primarily transferred onto the circulating transfer belt 50 by the primary transfer rollers 52 of the respective colors.

Further, the secondary transfer roller 66 and the assist roller 68 are driven to rotate by the circulating transfer belt 50, and the elastic belt 64 circulates. In addition, the cleaning roller 72 (see FIG. 1) is driven to rotate by the circulating elastic belt 64 to clean the outer peripheral surface of the elastic belt 64.

Then, the sheet member P to be transported passes through the transfer nip NT formed between the elastic belt 64 and the transfer belt 50, and the toner image formed on the transfer belt 50 is transferred onto the sheet member P.

Here, an operation of adjusting the parallelism between the axis of the secondary transfer roller 66 and the axis of the winding roller 56 in an inspection process before shipping the image forming apparatus 10 will be described. Furthermore, the purpose of adjusting the parallelism of the two axes is to put the image parallelism of the image formed on the sheet member P within a predetermined reference value.

In the inspection process, a rectangular frame-shaped test image which forms the edge of the image forming area. G is formed on the sheet member P. Then, the image inspection unit 24 of the image forming apparatus 10 or 510 detects the difference ΔL (=Lout−Lin) between the line image length Lout at one end and the line image length Lin at the other end, in the width direction, of the image forming area G (see FIGS. 12 and 13).

In the transfer device 538 according to the comparative example, the controller 606 illustrated in FIG. 19 receives the detection result of the image inspection unit 24 and controls the motor 562*d* illustrated in FIG. 18 when "ΔL" does not satisfy a predetermined reference. Specifically, the controller 606 operates the motor 562*d* to rotate the winding roller 56 supported by the support member 558. In other words, the controller 606 rotates the axis of the winding roller 56. Thus, the controller 606 adjusts the parallelism between the axis of the secondary transfer roller 66 and the axis of the winding roller 56 and puts "ΔL" within a predetermined reference value.

Here, in the transfer device 538, when "ΔL" does not satisfy the predetermined reference, the controller 606 rotates the winding roller 56 as described above, Therefore, the transfer belt 50 wound around the winding roller 56 may move in the apparatus depth direction (that is, the width direction of the transfer belt 50).

On the other hand, in the transfer device 38 according to the exemplary embodiment, the controller 106 illustrated in FIG. 14 receives the detection result of the image inspection unit 24, and controls the motor 102*d* illustrated in FIG. 1 when "ΔL" does not satisfy the predetermined reference. Specifically, the controller 106 operates the motor 102*d* to rotate the secondary transfer unit 54. In other words, the controller 106 rotates the axis of the secondary transfer roller 66, as illustrated in FIGS. 6A, 6B and 6C. Thus, the controller 106 adjusts the parallelism between the axis of the secondary transfer roller 66 and the axis of the winding roller 56 and puts "ΔL" within the predetermined reference value.

Here, in the transfer device 38, when "ΔL" does not satisfy the predetermined reference, the controller 106 rotates the axis of the secondary transfer roller 66 as described above. Therefore, the elastic belt 64 wound around the secondary transfer roller 66 may move in the apparatus depth direction (that is, the width direction of the elastic belt 64).

Then, when the elastic belt 64 moves in the apparatus depth direction (so-called belt walk), as illustrated in FIGS. 7A, 7B and 7C, the degree of swinging of the swinging portion 96*b* of the sensor 96 also changes. Thus, the sensor 96 detects the position of the elastic belt 64 in the apparatus depth direction.

The controller 106 receives the detection result of the sensor 96, and controls the motor 92 illustrated in FIG. 3 when the position of the elastic belt 64 in the apparatus depth direction does not satisfy a predetermined reference. Specifically, the controller 106 operates the motor 92 to rotate the eccentric cam 90 around the axis of the rotary shaft 90*b* as illustrated in FIGS. 8A, 8B and 8C.

Then, when the motor 92 rotates the eccentric cam 90, a portion on the front side of the shaft portions 68*b* of the assist roller 68 in the apparatus depth direction moves in the through hole 78*d* formed in the side plate 78. Here, the through hole 78*d* takes the form of an arc centered on the axis of the secondary transfer roller 66. Therefore, a change in the distance between the shaft portion 66*b* of the secondary transfer roller 66 and the axis of the assist roller 68 is prevented.

In this way, by the movement of the portion on the front side of the shaft portions 68*b* in the apparatus depth direction, as illustrated in FIGS. 9A, 9B and 9C, the assist roller 68 rotates about the portion on the back side of the shaft portions 68*b* of the assist roller 68 in the apparatus depth direction and is tilted with respect to the apparatus depth direction. Thus, the controller 106 puts the position of the elastic belt 64 in the apparatus depth direction within a predetermined reference value. In this way, the tilting unit 86 functions as a belt position adjustment unit that adjusts the position of the elastic belt 64 in the apparatus depth direction.

(Conclusion)

As described above, the transfer device 538 according to the comparative example rotates the axis of the winding roller 56 when "ΔL" does not satisfy a predetermined reference. Therefore, the transfer belt 50 may move in the apparatus depth direction (that is, the width direction of the transfer belt 50). On the other hand, the transfer device 38 of the present exemplary embodiment rotates the axis of the secondary transfer roller 66 when "ΔL" does not satisfy the predetermined reference.

Therefore, the transfer device 38 has a configuration in which the parallelism between the axis of the secondary transfer roller 66 and the axis of the winding roller 56 is adjusted, and movement of the transfer belt 50 in the width direction of the transfer belt 50 is prevented as compared with a case where the axial direction of the winding roller 56 is changed.

Further, in the transfer device 38, the support member 76 supports the secondary transfer roller 66 and the assist roller 68. Further, the adjustment unit 102 includes the shaft portion 102*a*, and rotates the axis of the secondary transfer roller 66 by rotating the support member 76 about the shaft portion 102*a* and adjusts the parallelism between the axis of the secondary transfer roller 66 and the axis of the winding roller 56. Therefore, the axis of the secondary transfer unit 54 rotates in a state where a relative positional relationship between the secondary transfer roller 66, the assist roller 68, and the elastic belt 64 is maintained.

Further, in the transfer device 38, the adjustment unit 102 includes the motor 102*d* which rotationally drives the secondary transfer unit 54 about the shaft portion 102*a*. In addition, the controller 106 receives the detection result of the image inspection unit 24 and operates the motor 102*d* to rotate the secondary transfer unit 54 when "ΔL" does not satisfy the predetermined reference. Therefore, the burden on an operator is reduced as compared with a case where the secondary transfer unit is manually rotated.

Further, in the transfer device 38, the secondary transfer unit 54 includes the unit 86 which tilts the axial direction of the assist roller 68. Therefore, the movement of the elastic belt 64 in the apparatus depth direction is prevented as compared with a case where the axial direction of the assist roller is always constant.

Further, in the transfer device 38, the tilting unit 86 tilts the axial direction of the assist roller 68 with respect to the axial direction of the secondary transfer roller 66 by moving a portion at one end of the assist roller 68 in the axial direction. A portion on the other end of the assist roller 68 in the axial direction is supported. Therefore, by separately moving the portion at the one end of the shaft portion of the assist roller and the portion at the other end of the shaft portion of the assist roller, the axial direction of the assist roller 68 is tilted with the simple configuration as compared with a case where the axial direction of the assist roller is tilted.

Further, in the image forming apparatus 10, through the provision of the transfer device 38, the movement of the transfer belt 50 in the apparatus depth direction is prevented. Therefore, the occurrence of image shift of each color (that is, color registration error) is prevented as compared with a case where the transfer device 538 is provided.

Further, in the image forming apparatus 10, the image inspection unit 24 detects the image parallelism, and the controller 106 receives the detection result of the image inspection unit 24. When "ΔL" does not satisfy the predetermined reference, the motor 102*d* is operated to rotate the secondary transfer unit 54. Therefore, unevenness in the detection of the image parallelism is prevented as compared with a case where the operator visually determines the image parallelism.

Second Exemplary Embodiment

An example of a transfer device and an image forming apparatus according to a second exemplary embodiment of the present disclosure will be described with reference to FIGS. 20 and 21. As for the second exemplary embodiment, parts different from those in the first exemplary embodiment will be mainly described.

(Transfer Device 338)

Figure 20:
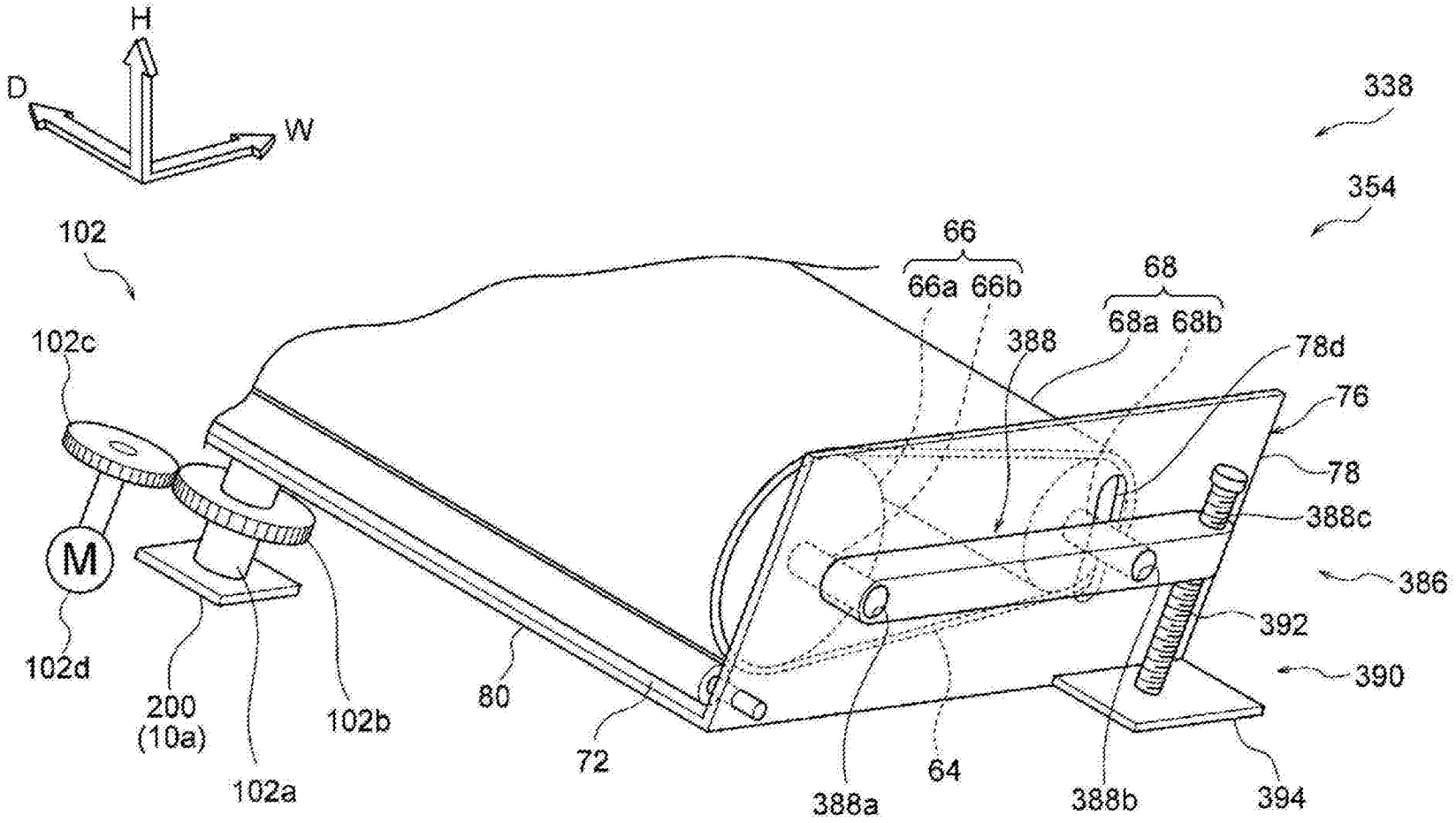
FIG. 20 is an enlarged perspective view illustrating a secondary transfer unit of a transfer device according to a second exemplary embodiment of the present disclosure.
Figure 21:
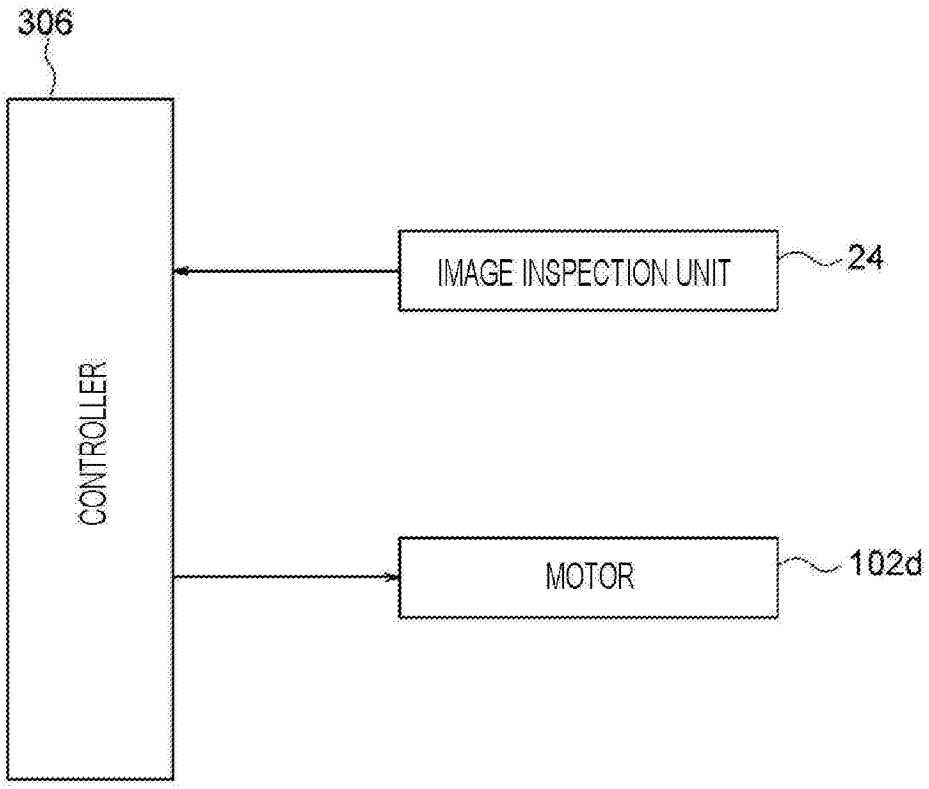
FIG. 21 is a block diagram illustrating a control system of a controller provided in the transfer device according to the second exemplary embodiment of the present disclosure.

The transfer device 338 according to the second exemplary embodiment includes the transfer belt 50, the primary transfer roller 52, the winding roller 56, and a controller 306 (see FIG. 21). In addition, as illustrated in FIG. 20, the transfer device 338 includes a secondary transfer unit 354 including the secondary transfer roller 66 and the adjustment unit 102.

[Secondary Transfer Unit 354]

As illustrated in FIG. 20, the secondary transfer unit 354 includes the secondary transfer roller 66, the assist roller 68, the elastic belt 64, the cleaning roller 72, the support member 76, and a tilting unit 386. Furthermore, the secondary transfer unit 354 is not provided with a sensor detects the position of the elastic belt 64 in the apparatus depth direction.

—Tilting Unit 386—

As illustrated in FIG. 20, the tilting unit 386 is disposed on a portion on the front side of the shaft portions 68*b* of the assist roller 68 in the apparatus depth direction. The tilting unit 386 includes a support member 388 which supports the portion on the front side of the shaft portions 68*b* of the assist roller 68 in the apparatus depth direction and a rotator 390 which rotates the support member 388.

The support member 388 extends in the apparatus width direction and has a rectangular cross section. The support member 388 is formed with a bearing portion 388*a* which supports the shaft portion 66*b* of the secondary transfer roller 66 and a bearing portion 388*b* which supports the shaft portion 68*b* of the assist roller 68. In addition, the support member 388 extends to the opposite side of the bearing portion 388*a* with the beating portion 388*b* interposed therebetween, and a through hole 388*c* is vertically formed in the extended portion. Further, a female screw is formed on the inner peripheral surface of the through hole 388*c*.

The rotator 390 includes a screw member 392 formed with a male screw which meshes with the female screw formed in the through hole 388*c* and a contact plate 394 which is in contact with a lower end of the screw member 392 in the vertical direction. The contact plate 394 has a rectangular shape when viewed in the plate thickness direction, and the edge of the contact plate 394 is mounted to the side plate 78 of the support member 76.

(Action)

In an inspection step before shipping the image forming apparatus 10, the controller 306 illustrated in FIG. 21 receives the detection result of the image inspection unit 24, and controls the motor 102*d* when "ΔL" does not satisfy a predetermined reference. Specifically, the controller 306 operates the motor 102*d* to rotate the secondary transfer unit 354. Thus, by adjusting the parallelism between the axis of the secondary transfer roller 66 and the axis of the winding roller 56, "ΔL" falls within a predetermined reference value.

Meanwhile, the secondary transfer roller 66 also rotates by the rotation of the secondary transfer unit 354. Thus, the elastic belt 64 may move in the apparatus depth direction (so-called belt walk). In this case, the operator rotates the support member 76 about the shaft portion 66*b* of the secondary transfer roller 66 by rotating the screw member 392. Thus, a portion on the front side of the shaft portions 68*b* of the assist roller 68 in the apparatus depth direction moves up and down. Then, the assist roller 68 rotates around a portion on the back side of the shaft portions 68*b* of the assist roller 68 in the apparatus depth direction and is tilted with respect to the apparatus depth direction. In this way, the operator puts the position of the elastic belt 64 in the apparatus depth direction within a predetermined reference value.

The other actions of the second exemplary embodiment are the same as the actions of the first exemplary embodiment other than the action exhibited by the transfer device 338 including the tilting unit 386.

Particular exemplary embodiments have been described in detail, but it will be apparent by those skilled in the art that the present disclosure is not limited to these exemplary embodiments and may adopt various other exemplary embodiments within the scope of the present disclosure. For example, in the above exemplary embodiments, the secondary transfer unit 54 or 354 is rotated using the motor 102*d*, but the operator may rotate the secondary transfer unit 54 or 354 without using a motor. In this case, the action exhibited by the provision of the motor 102*d* is not exhibited.

Further, toner images of plural colors are transferred onto the transfer belt 50 in the above exemplary embodiments, but a single color toner image may be transferred onto the transfer belt 50.

Further, in the above exemplary embodiments, the image inspection unit 24 detects the image parallelism, but the operator may detect the image parallelism by visually observing the sheet member P on which a rectangular frame-shaped test image is formed.

Further, the upper end of the shaft portion 102*a* of the adjustment unit 102 is mounted to the center portion of the bottom plate 80 of the support member 76 in the apparatus depth direction in the above exemplary embodiments, but the upper end of the shaft portion 102*a* may be mounted to a portion on the end of the bottom plate 80 of the support member 76 in the apparatus depth direction.

Further, the secondary transfer unit 54 or 354 includes the secondary transfer roller 66, the assist roller 68, and the elastic belt 64 in the above exemplary embodiments, but may not include the assist roller 68 and the elastic belt 64.

Further, the axial direction of the secondary transfer roller 66 is changed by rotating the secondary transfer unit 54 in the above exemplary embodiments, but the axial direction of the secondary transfer roller 66 may be changed by separately moving one end and the other end of the secondary transfer unit in the apparatus depth direction.

The foregoing description of the exemplary embodiments of the present disclosure has been provided for the purposes of illustration and description. It is not intended to be exhaustive or to limit the present disclosure to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer unit comprising a transfer belt wound around a rotating winding roller to circulate, an image being to be formed on the transfer belt, and a transfer roller disposed on an opposite side of the winding roller across the transfer belt, the transfer roller configured to transfer the image on the transfer belt to a recording medium; and an adjustment unit configured to change an axial direction of the transfer roller to adjust parallelism between an axis of the transfer roller and an axis of the winding roller, wherein the adjustment unit changes the axial direction of the transfer roller between at least two positions, and the transfer roller is configured to transfer the image from the transfer belt to the recording medium in each of the two positions.

2. An image forming apparatus comprising:

an image forming device configured to form an image; and the transfer device according to claim 1 comprising the transfer belt onto which the image formed by the image forming device is transferred.

3. A transfer device comprising:

a transfer unit comprising a transfer belt wound around a rotating winding roller to circulate, an image being to be formed on the transfer belt, and a transfer roller disposed on an opposite side of the winding roller across the transfer belt, the transfer roller configured to transfer the image on the transfer belt to a recording medium; and an adjustment unit configured to change an axial direction of the transfer roller to adjust parallelism between an axis of the transfer roller and an axis of the winding roller, wherein the transfer unit further comprises an assist roller separated from the transfer roller, an endless belt wound around the transfer roller and the assist roller, the endless belt being in contact with the transfer belt, and a support member that supports the transfer roller and the assist roller, and the adjustment unit comprises a shaft portion that rotatably supports the support member, the shaft portion being configured to change the axial direction of the transfer roller by rotating the transfer unit about the shaft portion.

4. The transfer device according to claim 3, wherein the adjustment unit comprises a drive unit configured to rotationally drive the transfer unit around the shaft portion, the transfer device further comprising:

a controller configured to control the drive unit based on image parallelism of the image transferred onto the recording medium, to rotate the transfer unit.

5. An image forming apparatus comprising:

an image forming device configured to form an image; and the transfer device according to claim 4 comprising the transfer belt onto which the image formed by the image forming device is transferred.

6. An image forming apparatus comprising:

an image forming unit configured to form an image;

the transfer device according to claim 4 comprising the transfer belt onto which the image formed by the image forming unit is transferred; and a detector configured to detect the image parallelism of the image transferred onto the recording medium, wherein the controller of the transfer device controls the drive unit of the transfer device based on a detection result of the detector.

7. The transfer device according to claim 4, wherein the transfer unit comprises another adjustment unit configured to adjust an axial direction of the assist roller with respect to the axial direction of the transfer roller.

8. An image forming apparatus comprising:

an image forming device configured to form an image; and the transfer device according to claim 7 comprising the transfer belt onto which the image formed by the image forming device is transferred.

9. The transfer device according to claim 7, wherein the other adjustment unit tilts the axial direction of the assist roller with respect to the axial direction of the transfer roller by moving a portion at one end of the assist roller in the axial direction, a portion at the other end of the assist roller in the axial direction being supported.

10. An image forming apparatus comprising:

an image forming device configured to form an image; and the transfer device according to claim 9 comprising the transfer belt onto which the image formed by the image forming device is transferred.

11. The transfer device according to claim 3, wherein the transfer unit comprises another adjustment unit configured to adjust an axial direction of the assist roller with respect to the axial direction of the transfer roller.

12. The transfer device according to claim 11, wherein the other adjustment unit tilts the axial direction of the assist roller with respect to the axial direction of the transfer roller by moving a portion at one end of the assist roller in the axial direction, a portion at the other end of the assist roller in the axial direction being supported.

13. An image forming apparatus comprising:

an image forming device configured to form an image; and the transfer device according to claim 12 comprising the transfer belt onto which the image formed by the image forming device is transferred.

14. An image forming apparatus comprising:

an image forming device configured to form an image; and the transfer device according to claim 11 comprising the transfer belt onto which the image formed by the image forming device is transferred.

15. An image forming apparatus comprising:

an image forming device configured to form an image; and the transfer device according to claim 3 comprising the transfer belt onto which the image formed by the image forming device is transferred.

16. A transfer device comprising:

a transfer unit comprising a transfer belt wound around a rotating winding roller to circulate, an image being to be formed on the transfer belt, and a transfer roller disposed on an opposite side of the winding roller across the transfer belt, the transfer roller configured to transfer the image on the transfer belt to a recording medium; and means for changing an axial direction of the transfer roller to adjust parallelism between an axis of the transfer roller and an axis of the winding roller.

17. The transfer device according to claim 16, wherein the means for changing the axial direction of the transfer roller between at least two positions, and the transfer roller is configured to transfer the image from the transfer belt to the recording medium in each of the two positions.

* * * * *